US008541705B2

(12) United States Patent
Dimig

(10) Patent No.: US 8,541,705 B2
(45) Date of Patent: Sep. 24, 2013

(54) ELECTRONIC COMMUNICATION DEVICE AND METHOD

(75) Inventor: Steven J. Dimig, Plymouth, WI (US)

(73) Assignee: Strattec Security Corporation, Milwaukee, WI (US)

( * ) Notice: Subject to any disclaimer, the term of this patent is extended or adjusted under 35 U.S.C. 154(b) by 0 days.

(21) Appl. No.: 13/012,441

(22) Filed: Jan. 24, 2011

(65) Prior Publication Data

US 2011/0162949 A1 Jul. 7, 2011

Related U.S. Application Data

(63) Continuation of application No. 13/055,389, filed as application No. PCT/US2008/008860 on Jul. 21, 2008, which is a continuation-in-part of application No. PCT/US2007/007806, filed on Mar. 29, 2007, which is a continuation-in-part of application No. 11/396,263, filed on Mar. 30, 2006, now Pat. No. 7,897,888.

(51) Int. Cl.
*H01H 13/06* (2006.01)

(52) U.S. Cl.
USPC ..... 200/302.2

(58) Field of Classification Search
USPC ..... 200/505, 302.2
See application file for complete search history.

(56) References Cited

U.S. PATENT DOCUMENTS

| | | | |
|---|---|---|---|
| 4,158,115 | A | 6/1979 | Parkinson et al. |
| 4,691,188 | A | 9/1987 | Watanabe et al. |
| 4,720,610 | A | 1/1988 | MacHarrie |
| 5,065,279 | A | 11/1991 | Lazenby et al. |
| 5,399,823 | A | 3/1995 | McCusker |
| 5,821,516 | A | 10/1998 | Vandenengel |
| 5,893,959 | A | 4/1999 | Muellich |
| 6,093,900 | A | 7/2000 | Wisskirchen et al. |
| 6,100,484 | A | 8/2000 | Houze et al. |
| 6,180,896 | B1 | 1/2001 | Naritomi |
| 6,208,271 | B1 | 3/2001 | Armstrong |
| 6,462,291 | B1 | 10/2002 | Sachs |

(Continued)

FOREIGN PATENT DOCUMENTS

| | | |
|---|---|---|
| CN | 2901703 | 5/2007 |
| DE | 102006031699 | 1/2007 |
| EP | 0165063 | 12/1985 |
| GB | 2417926 | 3/2006 |

OTHER PUBLICATIONS

PCT International Search Report for PCT/US2007/007806 dated Nov. 14, 2008, 2 pages.

(Continued)

*Primary Examiner* — R S Luebke
*Assistant Examiner* — Lheiren Mae Caroc
(74) *Attorney, Agent, or Firm* — Michael Best & Friedrich LLP

(57) ABSTRACT

An electronic communications device such as a key fob is provided, and in some embodiments comprises a flexible film and a spacer layer defining at least one aperture. The flexible film can cover at least a portion of the spacer layer, and defines an exterior surface of the key fob. The flexible film includes at least one contact surface and a surface adjacent to the at least one contact surface. The at least one contact surface flexes when a force is applied in order to actuate at least one switch.

31 Claims, 36 Drawing Sheets

(56) References Cited

U.S. PATENT DOCUMENTS

| | | | | |
|---|---|---|---|---|
| 6,479,775 | B2 | 11/2002 | Shigetaka et al. | |
| 6,571,457 | B2 | 6/2003 | Naritomi | |
| 6,573,463 | B2 | 6/2003 | Ono | |
| 6,589,229 | B1 | 7/2003 | Connelly et al. | |
| 6,614,380 | B1 * | 9/2003 | Desai et al. | 341/176 |
| 6,617,536 | B2 | 9/2003 | Kawaguchi | |
| 6,621,446 | B1 * | 9/2003 | Chaillie | 341/176 |
| 6,713,895 | B1 | 3/2004 | Krapfl | |
| 6,720,892 | B1 | 4/2004 | Lachor | |
| 6,722,916 | B2 | 4/2004 | Buccinna et al. | |
| 6,734,382 | B2 | 5/2004 | Arai et al. | |
| 6,747,223 | B2 | 6/2004 | Hattori | |
| 6,770,324 | B2 | 8/2004 | Hooker | |
| 6,770,824 | B1 | 8/2004 | Faucher | |
| 6,862,148 | B2 | 3/2005 | Kakinoki et al. | |
| 6,919,529 | B2 | 7/2005 | Franzen et al. | |
| 6,930,261 | B2 | 8/2005 | Nakade | |
| 6,980,095 | B2 | 12/2005 | Wright et al. | |
| 7,019,242 | B2 | 3/2006 | Kim | |
| 7,034,238 | B2 | 4/2006 | Uleski et al. | |
| 7,041,924 | B2 | 5/2006 | Jeschke et al. | |
| 7,046,136 | B2 | 5/2006 | Sugimoto et al. | |
| 7,050,292 | B2 | 5/2006 | Shimura et al. | |
| 7,151,237 | B2 | 12/2006 | Mahoney et al. | |
| 7,166,812 | B2 | 1/2007 | White et al. | |
| 7,262,379 | B2 | 8/2007 | Nishimura et al. | |
| 7,499,283 | B2 | 3/2009 | De Los Santos et al. | |
| 7,737,845 | B2 | 6/2010 | Fawcett et al. | |
| 7,897,888 | B2 | 3/2011 | Dimig | |
| 7,902,474 | B2 | 3/2011 | Mittleman et al. | |
| 2001/0037933 | A1 | 11/2001 | Hunter et al. | |
| 2003/0222755 | A1 | 12/2003 | Kemper et al. | |
| 2004/0057769 | A1 | 3/2004 | Ward et al. | |
| 2004/0200709 | A1 | 10/2004 | Sugimoto et al. | |
| 2004/0200798 | A1 | 10/2004 | Ekkert | |
| 2005/0199019 | A1 | 9/2005 | Marcelle et al. | |
| 2005/0205402 | A1 | 9/2005 | Wright et al. | |
| 2006/0023442 | A1 | 2/2006 | De Los Santos et al. | |
| 2007/0227866 | A1 | 10/2007 | Dimig | |
| 2007/0270013 | A1 | 11/2007 | Clark | |
| 2008/0073186 | A1 | 3/2008 | Kenmochi | |
| 2008/0284931 | A1 | 11/2008 | Kimura | |
| 2009/0243791 | A1 | 10/2009 | Partin et al. | |
| 2010/0206704 | A1 | 8/2010 | Shimura et al. | |
| 2011/0007463 | A1 | 1/2011 | Hodges | |

OTHER PUBLICATIONS

PCT Written Opinion of the International Searching Authority for PCT/US2007/007806 dated Nov. 14, 2008, 8 pages.

PCT International Search Report for Int'l Appl. No. PCT/US2008/008860 dated Jan. 14, 2009, 3 pages.

PCT Written Opinion of the Int'l Searching Authority for Int'l Appl. No. PCT/US2008/008860 dated Jan. 14, 2009, 7 pages.

First Office Action from the State Intellectual Property Office of China for Application No. 200780016932.3 dated Jan. 10, 2011 (English Translation—6 pages).

EP 08780271.6 Extended European Search Report dated Apr. 1, 2011 (6 pages).

EP 11000957.8 Extended European Search Report dated Apr. 13, 2011 (6 pages).

Office Action from the United States Patent and Trademark Office for U.S. Appl. No. 13/055,389 dated Apr. 17, 2012 (9 pages).

Second Written Opinion for International Application No. PCT/US2008/008860 dated Jun. 28, 2012 (7 pages).

International Preliminary Report on Patentability for Application No. PCT/US2008/008860 dated Feb. 1, 2013 (46 pages).

Office Action from the US Patent and Trademark Office for U.S. Appl. No. 13/055,389 dated Apr. 12, 2013 (10 pages).

* cited by examiner

ELECTRONIC COMMUNICATION DEVICE AND METHOD

CROSS-REFERENCE TO RELATED APPLICATIONS

This application is a continuation of and claims priority to U.S. patent application Ser. No. 13/055,389, filed Jan. 21, 2011, which application is a national stage application of and claims priority to International Patent Application PCT/US2008/008860, filed Jul. 21, 2008, which application is a continuation-in-part of and claims priority to International Patent Application PCT/US2007/007806, filed Mar. 29, 2007, which application is a continuation-in-part of and claims priority to U.S. patent application Ser. No. 11/396,263, filed Mar. 30, 2006, now U.S. Pat. No. 7,897,888, issued Mar. 1, 2011.

BACKGROUND OF THE INVENTION

Conventional key fobs often include a two-piece housing, molded silicone rubber buttons, a printed circuit board ("PCB"), an antenna, and a battery clip coupled to one of the two pieces of the housing. To reduce costs, the pieces of the housing are typically made from black plastic. At least one piece of the housing usually includes one or more apertures for receiving a button. The buttons are usually defined by a single piece of molded silicone rubber that is substantially the same size as the housing. In many cases, the molded rubber piece is positioned inside the two pieces of the housing with the buttons aligned with the apertures in the housing. The molded rubber piece also usually includes a lip around its perimeter that provides a seal between the two pieces of the housing. Carbon pieces can be attached to the undersides of the buttons. Normally, the PCB is positioned beneath the silicon rubber buttons and includes electrical traces. When a button is depressed, the carbon piece on the underside of the button closes the traces on the PCB and activates a desired feature on a vehicle.

For a family of conventional key fobs (having different functionalities), an entire family of tooling is typically required to accommodate varying numbers of buttons, patterns, textures, and other styling. Due to the costs of the additional tooling, molding a family of key fobs with different features and styling is usually difficult and expensive. Similar problems arise in other applications, such as for other portable and non-portable electronic communication devices (e.g., mobile phones, GPS devices, audio equipment, and the like).

SUMMARY OF THE INVENTION

In some embodiments, a key fob is provided, and comprises a spacer layer defining at least one aperture; and a flexible film covering at least a portion of the spacer layer and defining an exterior surface of the key fob, the flexible film including at least one contact surface and a surface adjacent to the at least one contact surface, the at least one contact surface flexing when a force is applied in order to actuate at least one switch.

Some embodiments of the present invention provide a key fob comprising a flexible circuit including at least one switch; and a flexible film covering at least a portion of the flexible circuit and defining an exterior surface of the key fob including at least one contact surface, the at least one contact surface flexing when a force is applied in order to actuate the at least one switch.

In some embodiments, a method of forming a key fob is provided, and comprises: providing a flexible spacer layer including at least one aperture; providing a flexible film defining an exterior surface of the key fob including at least one contact surface and a surface adjacent to the at least one contact surface, the at least one contact surface flexing when a force is applied in order to actuate at least one switch; and joining the flexible spacer layer and the flexible film.

Some embodiments of the present invention provide a key fob, comprising: a flexible film defining an exterior surface of the key fob including at least one contact surface, the at least one contact surface flexing when a force is applied in order to actuate the at least one switch; and encapsulating material defining at least a portion of an interior of the key fob.

In some embodiments, a method of forming a key fob is provided, and comprises: providing a flexible film defining an exterior surface of the key fob including at least one contact surface and a surface adjacent to the at least one contact surface, the at least one contact surface flexing when a force is applied in order to actuate at least one switch; and injecting an encapsulating material into a mold to define at least a portion of an interior of the key fob.

Some embodiments of the present invention provide a key fob, comprising: a substantially transparent flexible film defining an exterior surface of the key fob including at least one contact surface, the at least one contact surface flexing when a force is applied in order to actuate at least one switch included in the key fob, the substantially transparent flexible film including a printed interior surface.

In some embodiments, a key fob is provided, and comprises a flexible film defining an exterior surface of the key fob including at least one contact surface, the at least one contact surface flexing when a force is applied in order to actuate the at least one switch, the flexible film formed to define an upper surface and a side surface of the key fob.

Some embodiments of the present invention provide a method of forming a key fob, comprising: providing a substantially transparent flexible film defining an exterior surface of the key fob, the exterior surface including at least one contact surface, the at least one contact surface flexing when a force is applied in order to actuate the at least one switch; and printing on an interior surface of the substantially transparent flexible film.

Other aspects of the present invention will become apparent by consideration of the detailed description and accompanying drawings.

DETAILED DESCRIPTION OF THE INVENTION

Before any embodiments of the present invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly, and encompass both direct and indirect mountings, connections, supports, and couplings. Further, "connected" and "coupled" are not restricted to physical or mechanical connections or couplings.

Figure 1:
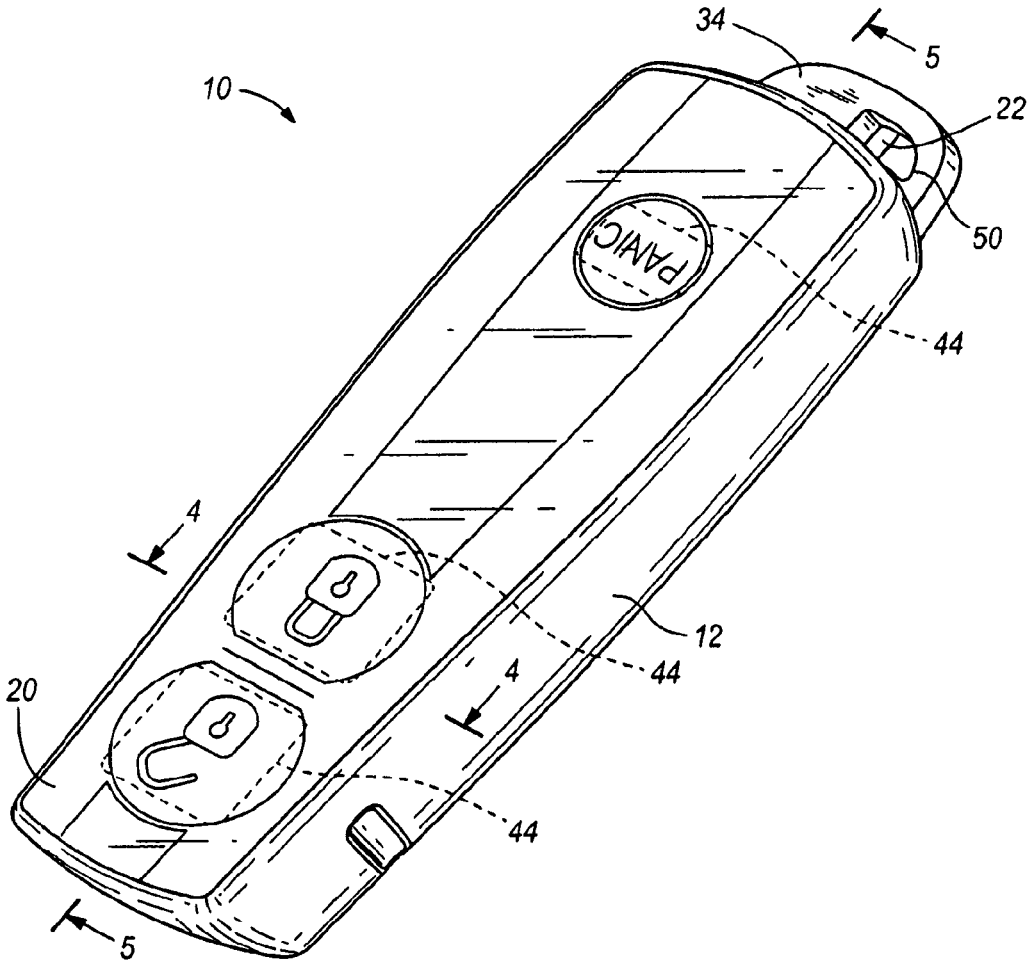
FIG. 1 is a perspective view of a key fob according to an embodiment of the present invention.
Figure 2:
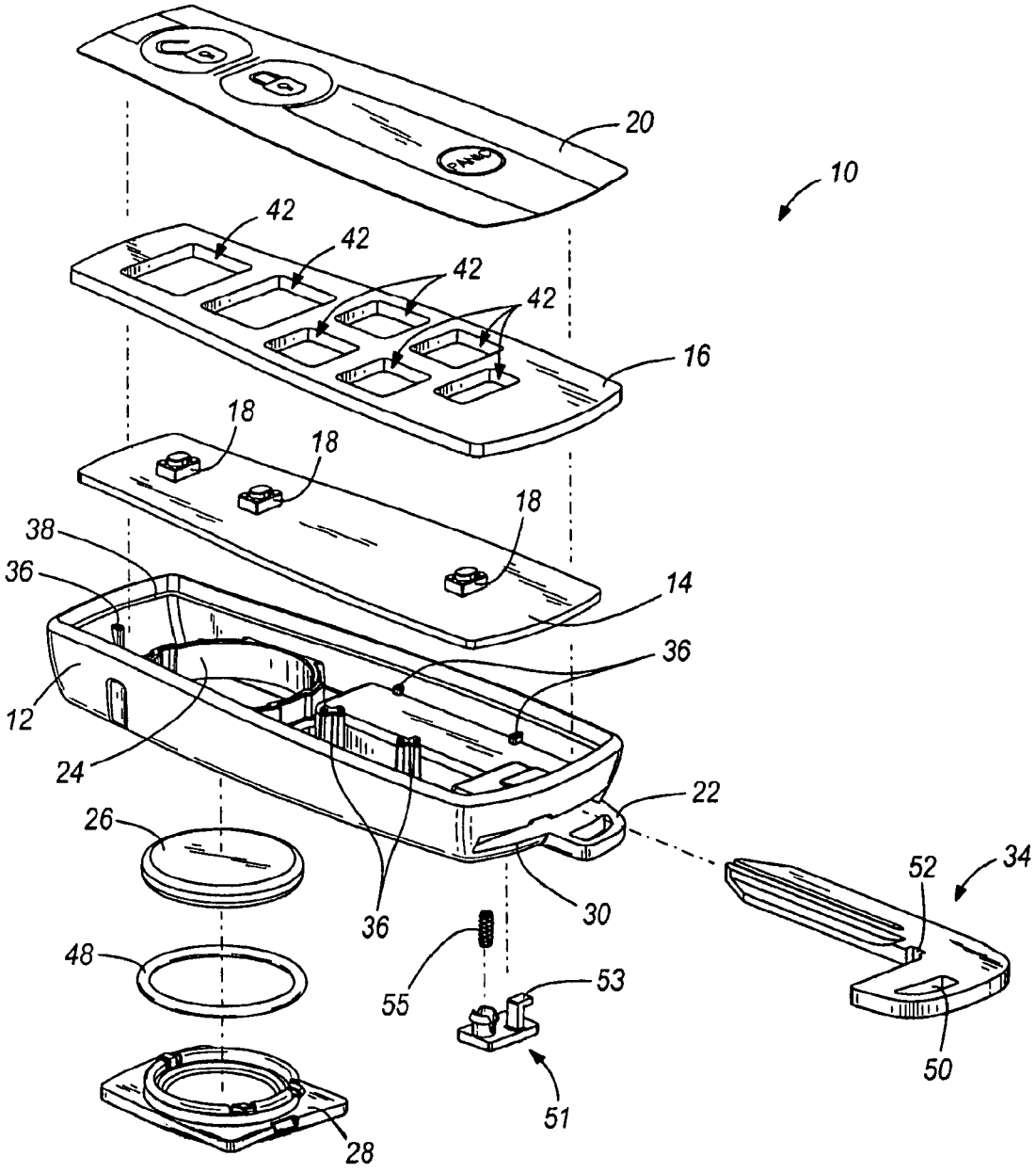
FIG. 2 is an exploded perspective view of the key fob of FIG. 1.

FIGS. 1-6 illustrate a key fob 10 according to an embodiment of the present invention. As shown in FIG. 2, the key fob 10 can include a housing 12, a printed circuit board (PCB) 14, a lid 16, one or more switches 18, and a flexible film 20. The housing 12 can be generally tub-shaped and can be constructed from plastic. In other embodiments, the housing 12 can be constructed from a composite material, a metal, or another suitable material. The housing 12 can include a valet hook 22 for hanging up the key fob 10. The housing 12 can include a cylindrical recess 24 that can receive a battery 26 and a battery access door 28. The housing 12 can include an elongated aperture 30 that can receive a mechanical key blade 34. The housing 12 can include standoffs 36 on an interior portion in order to provide surfaces to support the PCB 14. The standoffs 36 can help ensure that the PCB 14 is positioned correctly with respect to other components within the key fob 10. Above or at substantially the same vertical position of the standoffs 36, a shelf 38 can be defined around the perimeter of the housing 12. The shelf 38 can provide a surface to support the lid 16 above the PCB 14.

The PCB 14 can be shaped according to the shape of the interior portion of the housing 12. The PCB 14 can include electrical components that allow the key fob 10 to control various functions of a vehicle. These functions can include, but are not limited to, remotely actuating door locks, a trunk lock, lights, and an ignition. The PCB 14 can include an antenna (not shown), a controller (not shown), and one or more of the switches 18. The PCB 14 can receive power from the battery 26. The PCB 14 can be positioned between the standoffs 36 and the lid 16.

Figure 4A:
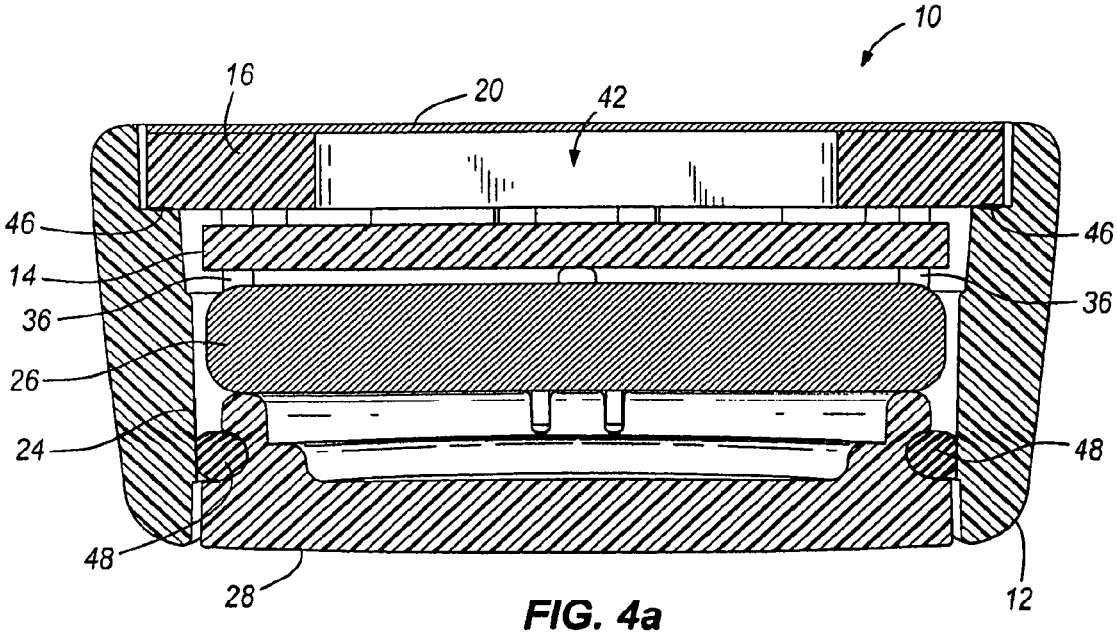
FIG. 4*a* is a cross-sectional view of the key fob of FIGS. 1-3, taken along line 4-4 of FIG. 1.
Figure 4B:
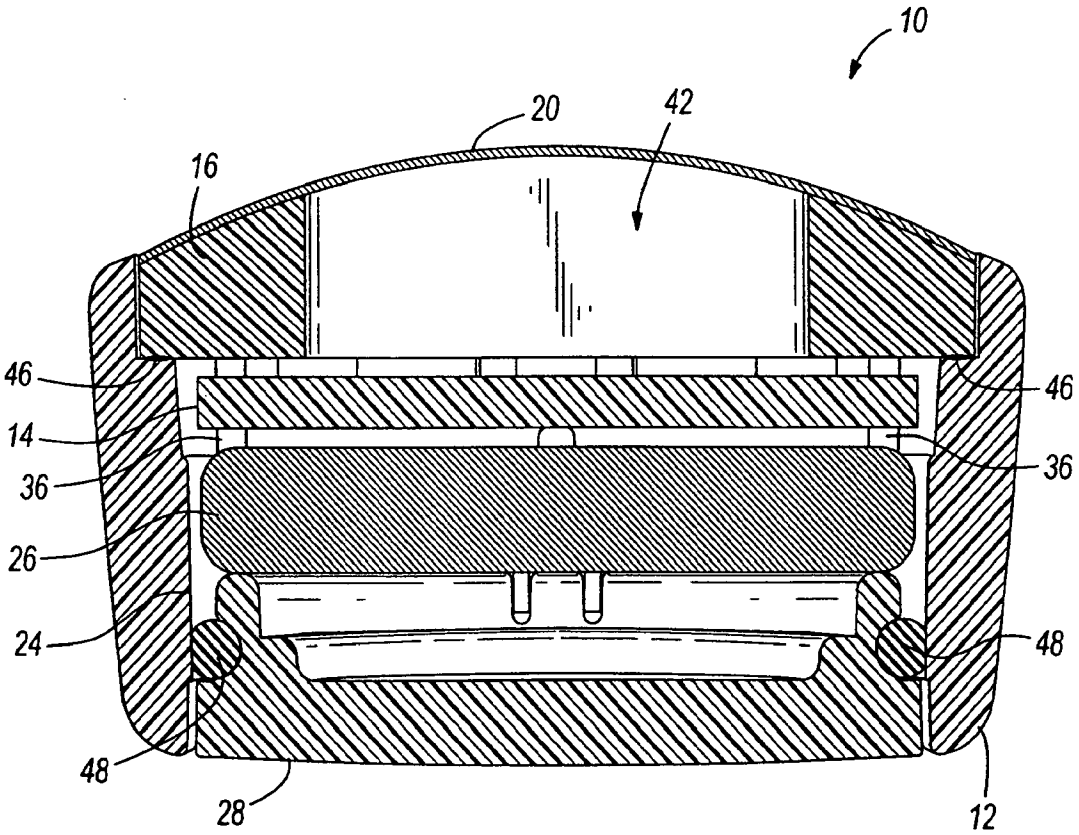
FIG. 4*b* is a cross-sectional view of an alternative embodiment of the key fob of FIGS. 1-3, taken along line 4-4 of FIG. 1.
Figure 5:
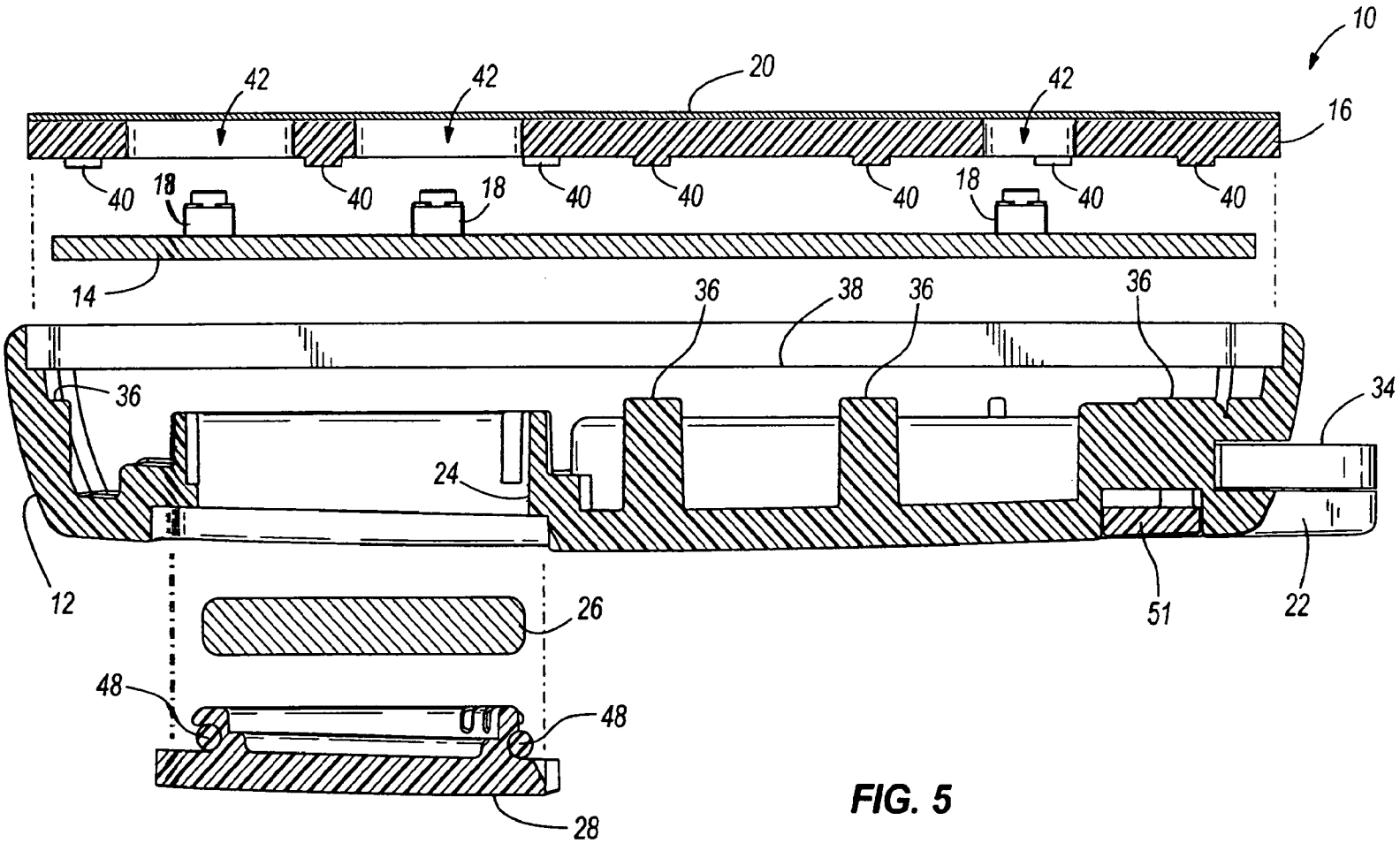
FIG. 5 is an exploded cross-sectional view of the key fob of FIGS. 1-3, taken along line 5-5 of FIG. 1

As shown in FIG. 5, the lid 16 can include one or more standoffs 40 and one or more apertures 42 defined in a sheet of a plastic material. In some embodiments, the lid 16 can be injection molded in order to define the standoffs 40 and the apertures 42. In other embodiments, the lid 16 can be constructed of metal or another suitable material. The standoffs 40 can contact portions of the PCB 14 away from the electrical components and/or the switches 18. When the lid 16 is joined to the housing 12, the standoffs 40 can help hold the PCB 14 in place by pressing the PCB 14 against the standoffs 36 of the housing 12 (as shown in FIGS. 4 and 5). The lid 16 can be positioned above the PCB 14 to allow the switches 18 to be actuated through the apertures 42.

In some embodiments, the switches 18 can be tact switches. For their size, tact switches typically require a relatively high force to actuate the switch. Tact switches also typically have a relatively short stroke (e.g., 0.25 mm) and generate an audible click when actuated. The number of switches 18 included in the fob 10 can be based on each application, such as each make in a family of vehicles. Rather than tact switches, other types of switches or actuators can be used. For example, an electrically-conductive material can be positioned under a contact surface of the flexible film 20 in order to contact two conductive traces on the PCB 14 to complete a circuit. In some embodiments, the switches 18 can be soldered onto the PCB 14 and can be positioned within the apertures 42, so that the top of the switch 18 is at or slightly below a top surface of the lid 16. The switches 18 can be actuated through each one of the corresponding apertures 42 in the lid 16.

Figure 8:
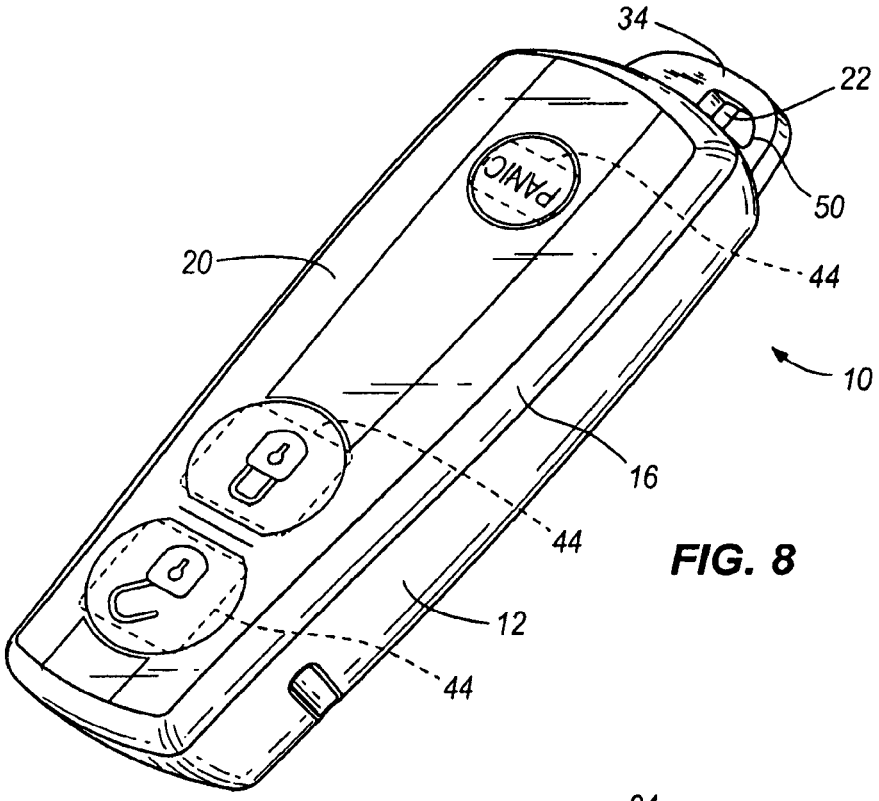
FIG. 8 is a perspective view of a key fob according to another embodiment of the present invention.
Figure 9:
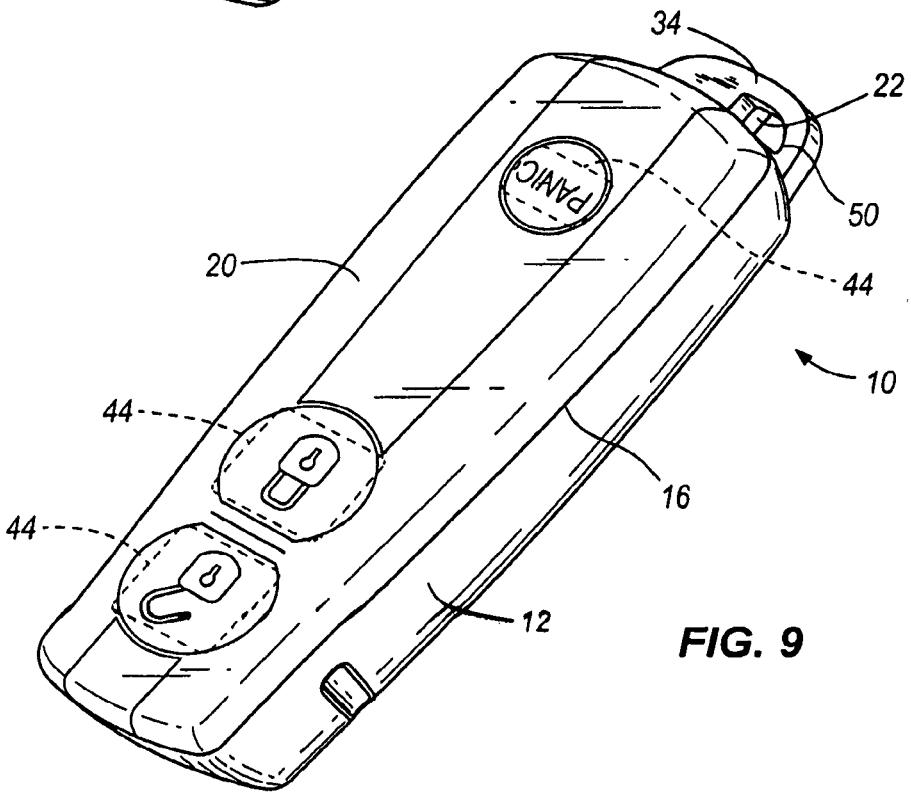
FIG. 9 is a perspective view of a key fob according to another embodiment of the present invention.

As shown in FIG. 2, the flexible film 20 can include a relatively thin piece of plastic having a perimeter substantially equal to the perimeter of the lid 16 and the housing 12. In some embodiments, the lid 16 can include a portion extending above the housing 12 as shown in FIGS. 8 and 9. In the embodiment shown in FIG. 8, the flexible film 20 can have a smaller perimeter than the perimeter of the lid 16. In the embodiment shown in FIG. 9, the flexible film 20 can be thermoformed such that the shape of the flexible film 20 substantially matches the contour of the lid 16. The flexible film 20 can define contact surfaces 44 above one or more of the apertures 42. In some embodiments, the flexible film 20 is coupled to the lid 16 by an adhesive. In other embodiments, the flexible film 20 can be coupled to the lid 16 by at least one of injection molding the lid 16 onto the flexible film 20, laser welding, or sonic welding. In still other embodiments, the flexible film 20 can be coupled to the lid 16 by snap fitting the flexible film 20 to the lid 16.

With reference again to FIG. 1, as an example only, the key fob 10 can include three contact surfaces 44 corresponding to three vehicle functions. As shown in FIG. 2, the key fob 10 can include three switches 18 corresponding to the three contact surfaces 44. However, the number of switches 18 and contact surfaces 44 can vary depending on remotely actuated functions required for a particular vehicle.

Figure 3:
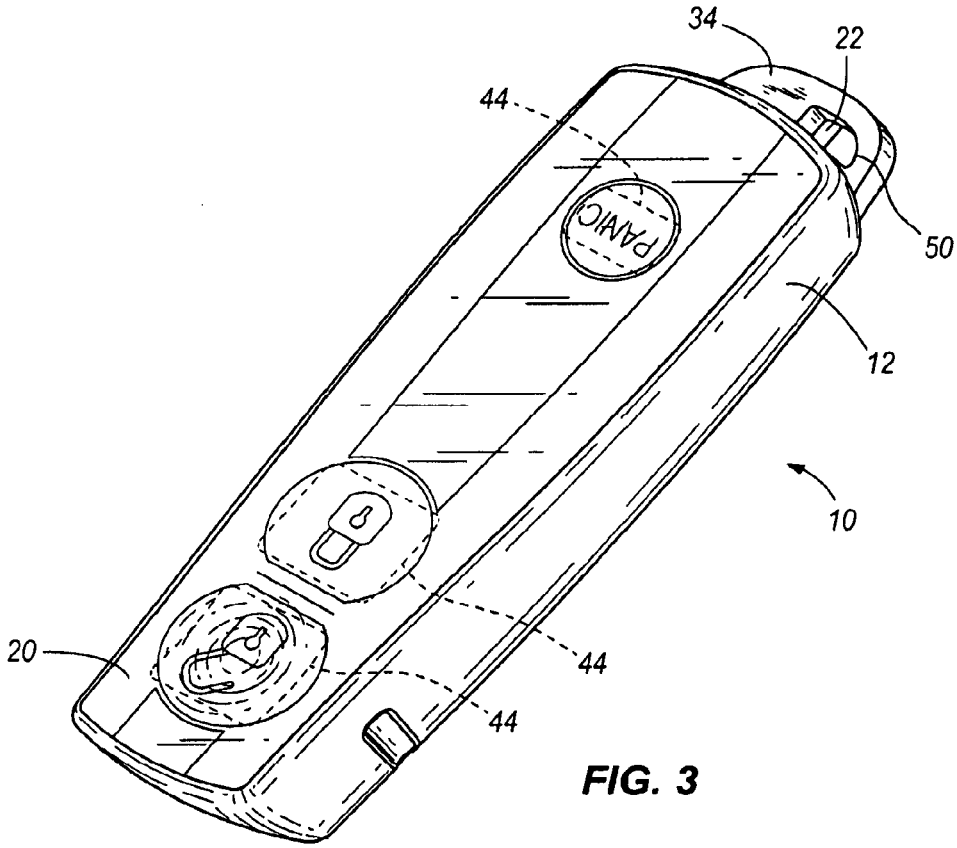
FIG. 3 is a perspective view of the key fob of FIG. 1, illustrating a flexible film being depressed to actuate a switch.

As shown in FIG. 3, a switch 18 can be actuated through one of the apertures 42 by pressing a contact surface 44 of the flexible film 20, which can flex enough to actuate the switch 18. Due to the positioning of the switch 18 and its short stroke, the flexible film 20 only needs to flex a minimal distance to actuate the switch 18. The life of the flexible film 20 can be extended by using switches with a short stroke that only requires the flexible film 20 to flex a minimal distance. The audible and tactile click of the switch 18 can alert the operator that the switch 18 has been depressed.

In some embodiments, the flexible film 20 can be screen printed on one or both sides in order to add stylized graphics, contact surfaces, textures, and the like in any combination on the interior and/or exterior surfaces of the flexible film 20. In some embodiments, the flexible film 20 can be screen printed or otherwise stylized on an interior side in order to provide graphics, contact surfaces, or textures less susceptible to fading and wearing than graphics, contact surfaces, and textures printed on an exterior side of the flexible film 20. For example, words or graphics defining contact surfaces 44 can be printed on an interior surface of the flexible film 20, and textures can be printed on an exterior surface of the flexible film 20. In other embodiments, multiple flexible films 20 can be layered to add stylized graphics, contact surfaces, textures, and the like to the key fob 10. For example, the key fob 10 can include a first flexible film printed with a background color for the key fob 10. A second flexible film printed with graphics, text, and the like can then be placed on top of the first flexible film. The second flexible film can include substantially transparent portions in order to display the color, graphics, text, textures, patterns, and the like printed on the first flexible film.

In some embodiments, each individual flexible film 20 is die-cut to shape from a sheet of flexible film. Also in some embodiments, the flexible film 20 can be constructed from a clear polycarbonate resin. The flexible film 20 can be relatively thin (e.g., approximately 0.4-0.5 mm thick). Screen printing can be used to provide high resolution printing in a single or multiple layers at a relatively low cost. Other embodiments can use other methods of customizing the flexible film 20, such as laser printing, colored films, decals, and the like.

In addition to printing graphics and contact surfaces 44 on the flexible film 20, it is possible to print a rail of thicker ink around the contact surfaces 44 to provide a tactile boundary for one or more contact surfaces 44. Additionally, more plastic or polydoming material can be located within or outside of (e.g., poured into or around) the rail of thicker ink to fill in and/or dome the contact surface 44 or to otherwise change the contour of the contact surface 44 or area(s) surrounding the contact surface 44. For example, where additional material is placed within a rail of thicker ink, a domed surface can be formed to correspond to one or more of the switches 18. A domed surface can also be created using embossing techniques. Similar techniques for providing tactile surfaces on the flexible film 20 can also be used to provide surfaces replicating rubber, leather, wood, metal, fabric, and the like. For example, in some embodiments, the flexible film 20 can be printed with a metallic-based paint or substance, such as chrome and/or aluminum paint, in order to provide a pseudo chrome surface on the key fob 10. As discussed above, such surfaces can be defined on either or both sides of the flexible film 20.

In some embodiments, the flexible film 20 can have raised contact surfaces 44 created by thermoforming the flexible film 20. Thermoforming can include heating the flexible film 20 and applying a vacuum between the flexible film 20 and a die representative of a desired shape for the contact surface 44. In some embodiments, the lid 16 can be formed with a domed shape, and the flexible film 20 can be thermoformed to match the domed shape of the lid 16, as shown by way of example in FIG. 4*b*. As shown, for example, in FIGS. 56-63 and described below, the flexible film 20 can also be shaped to provide beveled or faceted edges, grooves, and/or other shapes. Such shapes can be made by thermoforming the flexible film 20 or by other suitable methods.

Screen printing of the flexible film 20 can allow for customized styling of the key fob 10 for different vehicles, but for use with the same housing 12, PCB 14, and lid 16. In some embodiments, another flexible film can be coupled to the underside of the housing 12 to add additional stylized graphics and/or textures to the key fob 10.

The number of switches 18 in each key fob 10 can vary. However, in some embodiments, the number of apertures 42 in the lid 16 can be the same for each key fob 10. For example, the lid 16 can include enough apertures 42 for the maximum number of functions that can be controlled for any make in a family of vehicles. However, the number of switches 18 and contact surfaces 44 can be the same as or less than the number of apertures 42 in the lid 16. For a vehicle make, the desired number of switches 18 can be soldered to the PCB 14 in desired locations. When the flexible film 20 is screen printed, a contact surface 44 can be printed to be positioned over each switch 18 on the PCB 14. The flexible film 20 can be pressed and flexed over the apertures 42 that do not include a switch 18, but the flexible film 20 can be sufficiently resilient to spring back without a switch 18 forcing it back. If desired, the lid 16 can be redesigned at minimal cost to eliminate the apertures 42 in the lid 16 where a switch 18 is not needed.

FIGS. 4*a*, 4*b*, and 5 illustrate cross-sections of the key fob 10. The key fob 10 can be assembled almost entirely in a single position, meaning that the components do not need to be turned over until the end of the assembly, which speeds the process and lowers costs. The PCB 14 (which can include the necessary electronic components and required number of switches 18 for the particular vehicle model) can be placed into the housing 12 so that the PCB 14 rests on the standoffs 36 in the housing 12. The lid 16 can be placed on top of the PCB 14. Depending on the manufacturing process chosen for the lid 16, the lid 16 can be separate from the flexible film 20 or already joined to the flexible film 20 (such as by injection molding or another suitable process as described above). If the flexible film 20 is not already joined to the lid 16, the flexible film 20 can be placed on top of the lid 16 and joined to the lid 16 by adhesive, laser welding, sonic welding, or by another suitable method in order to form a watertight seal between the lid 16 and the flexible film 20.

In some embodiments, laser welding can be used to join the lid 16 to the housing 12. For example, a portion of the flexible film 20 and the lid 16 can be constructed of a material that transmits energy from the laser, while a portion of the housing 12 can be constructed of a material that absorbs energy from the laser. As shown in FIGS. 4*a* and 4*b*, the laser beam can be transmitted through the flexible film 20 and the lid 16 and absorbed by the housing 12 at a point 46 in order to heat the shelf 38 of the housing 12 to its melting point. This can cause the shelf 38 of the housing 12 to bond to the lid 16 and, in some embodiments, to the flexible film 20. If laser welding is used, a transparent region can be left around the perimeter of the flexible film 20 through which energy can be transmitted from the laser. For example, in some embodiments, that portion of the flexible film 20 that will be attached to the lid 16 and housing 12 can be made from a clear material, and that portion of the lid 16 that will be attached to the flexible film 20 and housing 12 can be made from an opaque white material (both of which can transmit energy from the laser), while the housing 12 can be made from a material that is substantially black or has a darker color and absorbs energy from the laser. In other embodiments, the housing 12 can be joined to the lid 16 and the flexible film 20 with an adhesive, by sonic welding, or by another suitable method capable of forming a watertight seal between the housing 12, the lid 16, and the flexible film 20.

After most of the components have been assembled, the key fob 10 can be turned over to install the battery 26 and the removable battery access door 28. The battery access door 28 can snap into the housing 12 and can be sealed against the housing 12 with an o-ring 48 in the cylindrical aperture 24. In some embodiments, the cylindrical aperture 24 and the o-ring 48 can be used in all the key fobs 10 for a line of vehicles, and the battery access door 28 can have any one of a variety of shapes (e.g., square, round, covering the entire back of the key fob 10, irregular shapes, and the like) for each vehicle make. The battery access door 28 can also include, for example, a mirror, a company logo, or other stylized graphics for a particular vehicle make. In some embodiments, screen printed film can be coupled to the battery access door 28 to provide the stylized graphics or the company logo.

Figure 6:
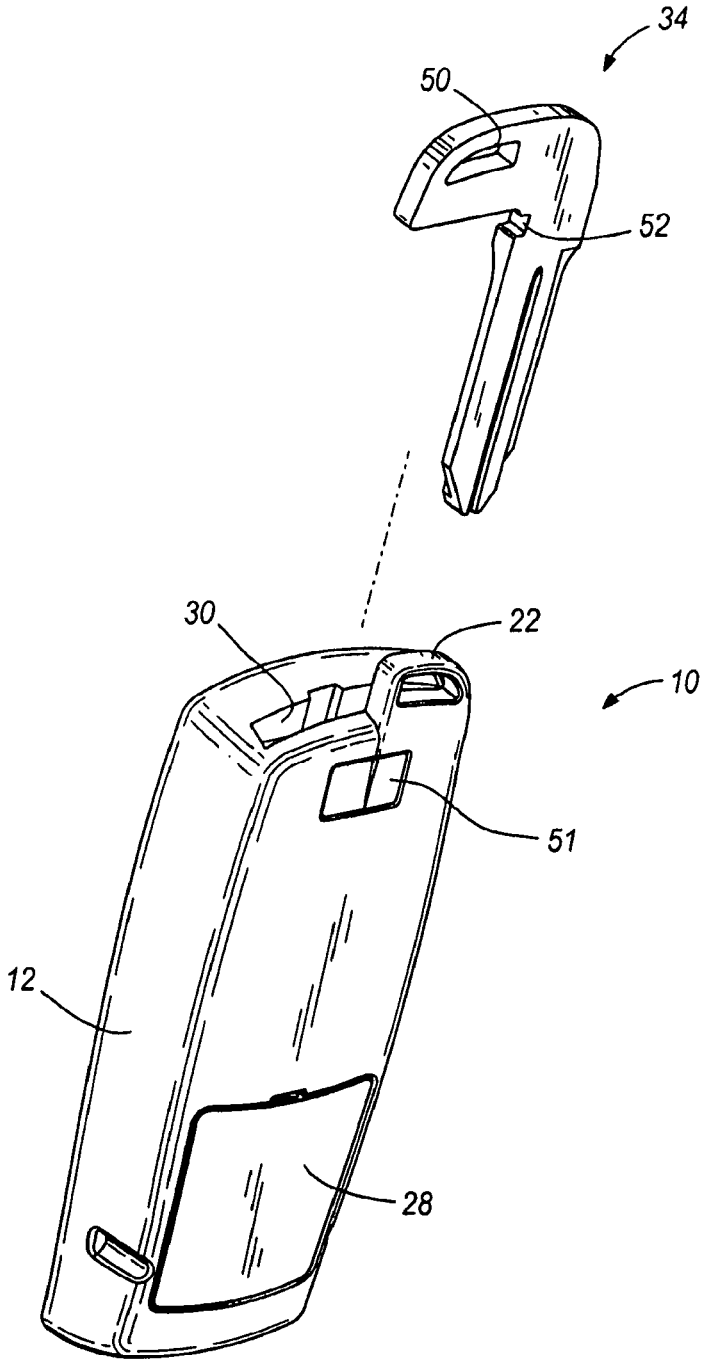
FIG. 6 is a perspective view of the key fob of FIGS. 1-3, illustrating a removable mechanical key blade.

FIG. 6 illustrates a mechanical key blade 34 that can be stored in the housing 12. The mechanical key blade 34 can be used to manually operate the door locks, ignition, trunk, and the like. The mechanical key blade 34 can include a relatively small head with an aperture 50 for attaching the mechanical key blade 34 to a key ring, or other device. As shown in FIG. 2, the mechanical key blade 34 can slide into the elongated aperture 30 in the housing 12 and can be held in place by a release button 51 on the housing 12 that can engage a recess 52 on the mechanical key blade 34. The release button includes a protrusion 53 that engages the recess 52. A spring 55 biases the release button 51 toward a position wherein the mechanical key blade 34 is retained within the housing 12. The illustrated mechanical key blade 34 can be released by depressing the release button 51, which disengages the protrusion 53 from the recess 52. In some embodiments, when the mechanical key blade 34 is inserted into the elongated aperture 30, the head can cover the valet hook 22. When the mechanical key blade 34 is removed from the housing 12, the valet hook 22 can be exposed, allowing the key fob 10 to be hung. In some embodiments, the mechanical key blade 34 can be held in the elongated aperture 30 tightly enough by the release button 51 that the key fob 10 can be carried on a key ring via the aperture 50 in the head. This arrangement allows the operator to detach the key fob 10 from the mechanical key blade 34, which can remain on the operator's key ring, in order to provide only the key fob 10 to a valet. In some embodiments, the key fob 10 can be used to actuate the vehicle's ignition, but not to open the vehicle's trunk, glove box, and/or other secure area. This is particularly useful if the operator wishes to have the car parked by a valet. The valet can use the key fob 10 to unlock the doors, drive, park, and lock the doors, but the valet cannot access the trunk. Numerous other scenarios may arise in which the operator wishes to detach the key fob 10 for vehicle use, but retain the mechanical key blade 34.

Figure 7:
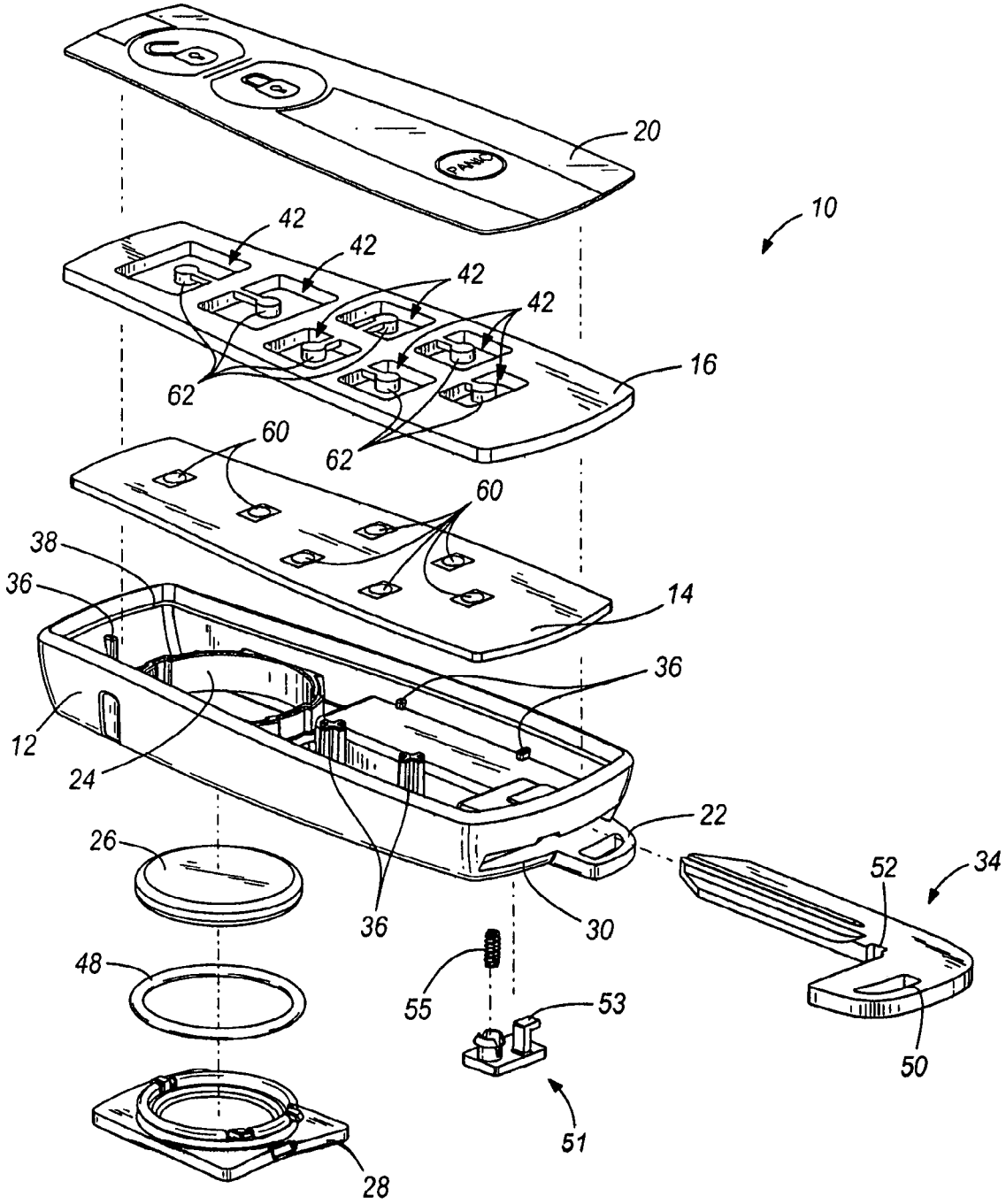
FIG. 7 is an exploded perspective view of the key fob of an alternative embodiment of FIG. 1.

FIG. 7 illustrates the key fob 10 in an alternative embodiment. The embodiment of FIG. 7 is substantially identical to the embodiment of FIGS. 1-6, but includes dome switches 60 rather than the tact switches 18 of FIGS. 1-6, and has a lid 16 modified for use with dome switches 60. The dome switches 60 can have a much lower profile than the tact switches 18, and thus can require actuators 62 positioned within the apertures 42 of the lid 16 to be actuated. When an operator applies force to a contact surface 44, the flexible film 20 transfers the force to the actuator 62. The actuator 62 is flexible, and will bend enough to actuate the dome switch 60. In some embodiments, the actuators 62 are integrally formed with the lid 16, whereas in other embodiments, the actuators 62 can be separate elements attached to the lid 16 within the apertures 42 in any suitable manner.

Figure 10:
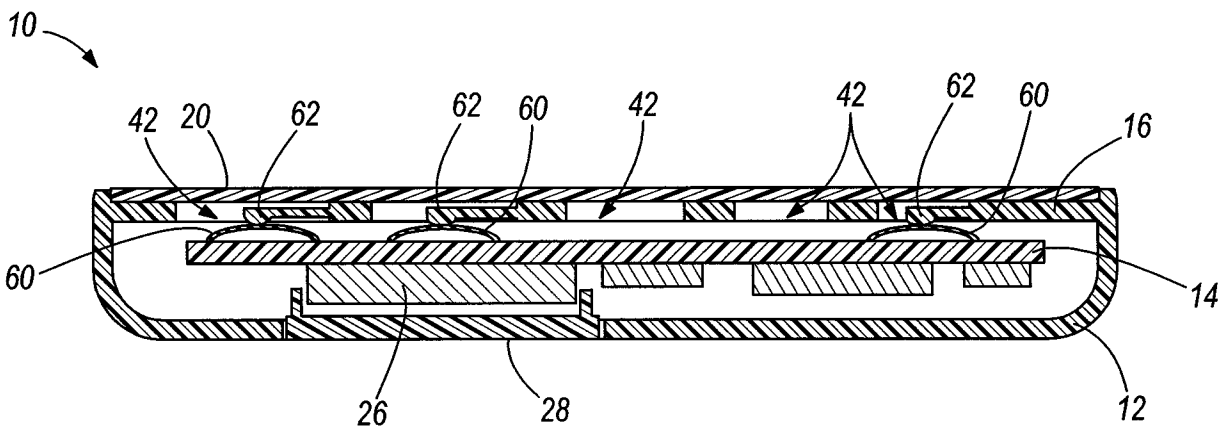
FIG. 10 is a cross-sectional view of the key fob of FIG. 7, taken along line 10-10 of FIG. 7.

The actuators 62 are biased away from the dome switches 60, such that when an operator removes the force applied to the contact surface 44, the actuator 62 will retract from the dome switch 60. In the illustrated embodiment of FIG. 7, an actuator 62 can be positioned in every aperture 42 of the lid 16. Similar to the tact switches 18 described earlier, the number of dome switches 60 can vary between key fobs 10. To reduce costs associated with manufacturing key fobs 10, actuators 62 can be positioned in each aperture 42 of the lid 16, whether or not a dome switch 60 is positioned within the aperture 42. This means that only one lid 16 needs to be manufactured for any key fob 10, regardless of the number of dome switches 60 that are included in the key fob 10. If dome switches 60 and actuators 62 are used in conjunction with a dome-shaped lid 16 (as in FIG. 4*b*, for example), longer actuators 62 can be used to ensure that the actuator 62 flexes to engage the dome switch 60, which is generally centered in the aperture 42. FIG. 10 illustrates a cross-sectional view of the key fob 10 of FIG. 7. In some embodiments, the key fob 10 of FIG. 7 can be assembled as described above with respect to the key fob of FIGS. 1-6 (see FIGS. 4*a*, 4*b*, and 5).

Figure 11A:
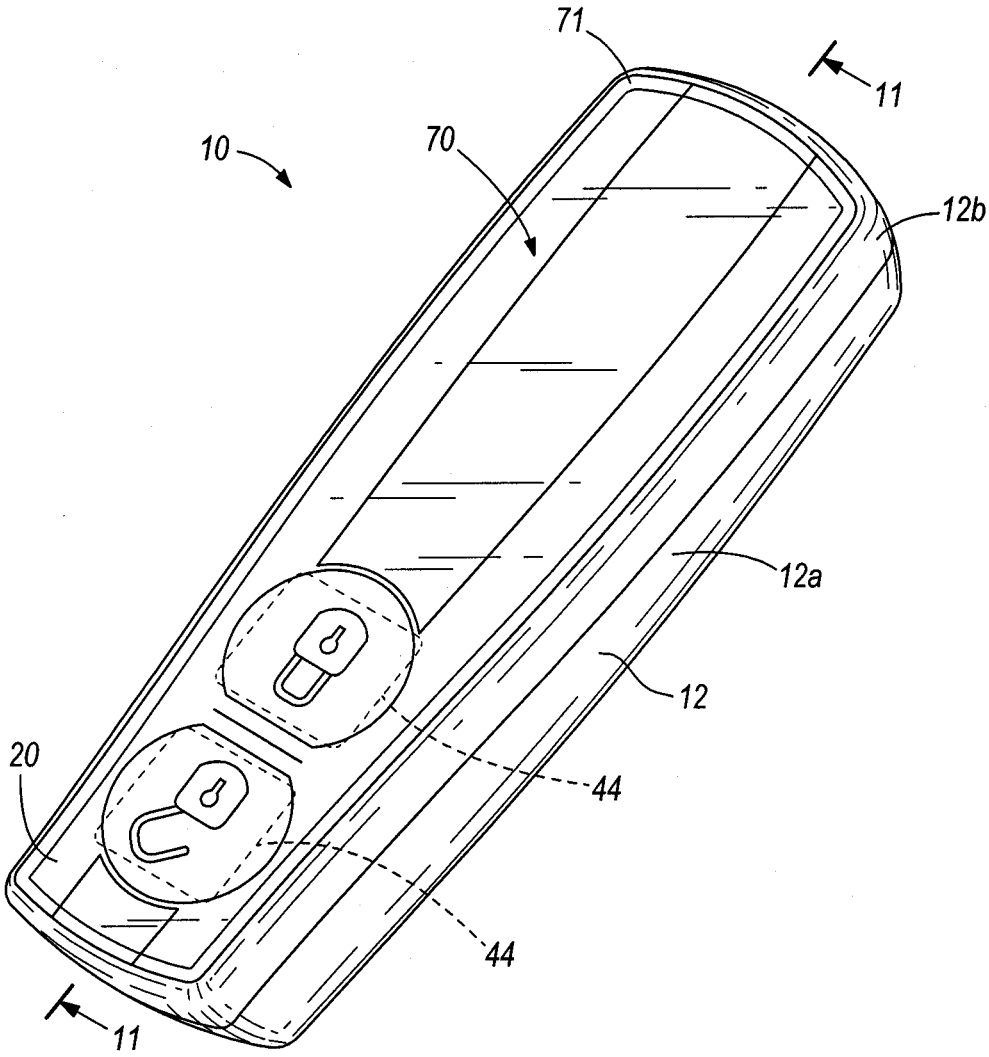
FIG. 11*a* is a perspective view of a key fob according to another embodiment of the present invention.

FIG. 11*a* illustrates a key fob 10 according to another embodiment of the present invention. As shown in FIG. 11*a*, the illustrated key fob 10 includes a housing 12 and a flexible film 20 including a plurality of contact surfaces 44. The housing 12 illustrated in FIG. 11*a* includes a lower housing 12*a* and an upper housing 12*b*. The lower housing 12*a* covers a lower portion of the key fob 10, and the upper housing 12*b* covers an upper portion of the key fob 10. Although the lower housing 12*a* and the upper housing 12*b* are shown in FIG. 11*a* as each covering approximately one half of the thickness of the key fob 10, other ratios can be used. For example, in some embodiments, the lower housing 12*a* can define approximately 75% of the thickness of the key fob 10 and the upper housing 12*b* can define approximately 25% of the thickness of the key fob 10.

In some embodiments, the lower housing 12*a* can be generally tub-shaped as the housing 12 described above with respect to FIGS. 1-6. Similarly, as described above, the lower housing 12*a* can include a cylindrical recess 24 that can receive a battery 26 and a battery access door 28. In addition, the lower housing 12*a* can include standoffs (not shown) on an interior portion in order to provide surfaces to support a PCB 14. Furthermore, the lower housing 12*a* can include an elongated aperture (not shown) that can receive a mechanical key blade 34 as described above with respect to FIG. 6.

As shown in FIG. 11*a*, the illustrated upper housing 12*b* includes an opening 70 and a rim 71. In some embodiments, the rim 71 extends around the perimeter of the opening 70 and covers at least a portion of the flexible film 20. Therefore, the rim 71 can frame at least a portion of the flexible film 20 within the opening 70. In other embodiments, the rim 71 can include one or more tabs that extend from the perimeter of the opening 70 and cover at least a portion of the flexible film. Through the opening 70, a user can apply force to one or more of the contact surfaces 44 provided on the flexible film 20. In some embodiments, the opening 70 can include a substantially transparent flexible cover 71*a* (e.g., a substantially transparent film, see FIG. 12). The flexible cover 71*a* can protect the flexible film 20 and other components of the key fob 10 from dust, debris, and moisture, while still allowing a user to view and apply force to the contact surfaces 44 provided on the flexible film 20.

The lower housing 12*a* and the upper housing 12*b* can be constructed from plastic, rubber, silicone, or another suitable material. In other embodiments, the lower housing 12*a* and the upper housing 12*b* can be constructed from a composite material, a metal, or another suitable material. In some embodiments, the lower housing 12*a* and the upper housing 12*b* can be constructed from different materials. The lower housing 12*a* and the upper housing 12*b* can be joined using a snap or force fit. The lower housing 12*a* and the upper housing 12*b* can also or instead be joined using an adhesive bonding material, laser welding, sonic welding, or by another suitable method. For example, as described above with respect to FIGS. 1-6, the lower housing 12*a* and the upper housing 12*b* can be laser welded by passing a laser through at least a portion of the flexible film 20. When joined, the lower housing 12*a* and the upper housing 12*b* can form a watertight seal between the lower housing 12*a* and the upper housing 12*b*.

Figure 11B:
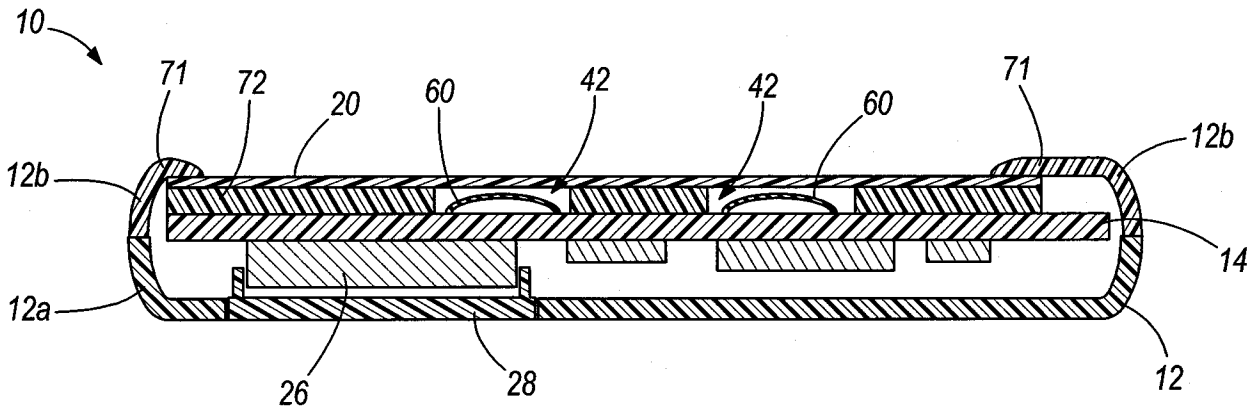
FIG. 11*b* is cross-sectional view the key fob of FIG. 11*a*, taken along line 11-11 of FIG. 11*a*.
Figure 12:
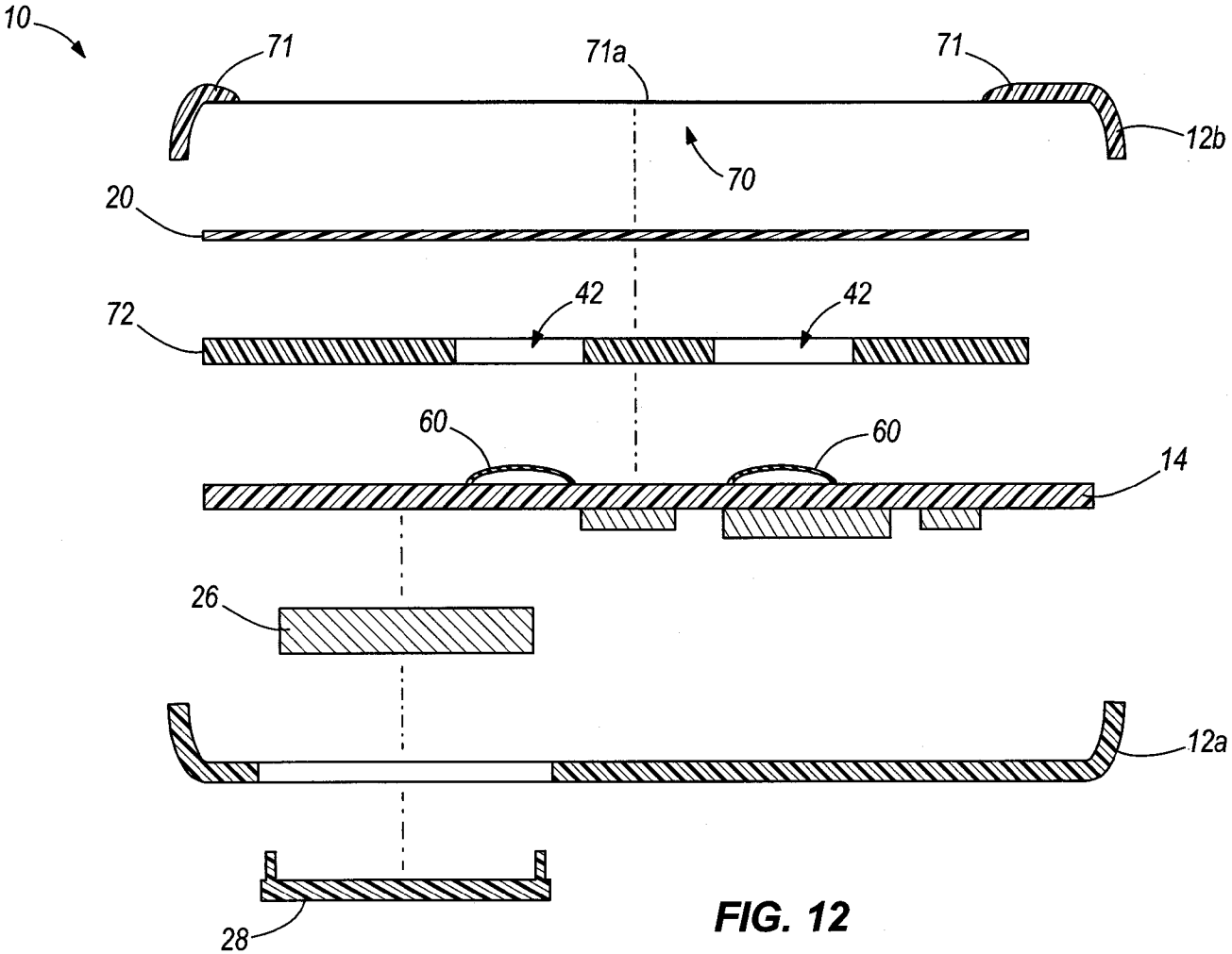
FIG. 12 is an exploded cross-sectional view of the key fob of FIGS. 11*a-b*.

FIGS. 11*b* and 12 are cross-sectional views the key fob of FIG. 11*a* taken along line 11-11 of FIG. 11*a* according to an embodiment of the invention. As shown in FIGS. 11*b* and 12, the illustrated key fob 10 includes an upper housing 12*b*, a flexible film 20, a spacer layer 72, a PCB 14 with one or more switches (e.g., one or more dome switches 60), a battery 26, a lower housing 12*a*, and a removable battery access door 28. Similar to the lid 16 described above with respect to FIGS. 1-10, the spacer layer 72 defines one or more apertures 42, which align with one or more switches 60 on the PCB 14. Although the spacer layer 72 can be constructed of any of the materials described above in connection with the lid 16 of the earlier-described embodiments, the illustrated spacer layer 72 is constructed from one or more layers of flexible film, similar to the flexible film 20. For example, the spacer layer 72 can be die-cut from a sheet of composite film layers. As compared to injection molding, processes such as cutting, die-cutting, stamping, or punching the spacer layer 72 from a sheet of material allows the position and number of apertures 42 to be modified relatively easily and inexpensively.

Similar to the key fobs of FIGS. 1-10, in some embodiments, the key fob 10 of FIGS. 11*a*, 11*b*, and 12 can be constructed almost entirely in a single position. Therefore, the key fob components do not need to be turned over until the end of assembly, which can speed the manufacturing process and lower manufacturing costs. For example, the key fob 10 of FIGS. 11*a*, 11*b* and 12 can be back assembled or loaded (e.g., assembled through the back of the key fob 10) by initially placing the flexible film 20 into the upper housing 12*b*. As noted above, the rim 71 of the upper housing 12*b* can cover a portion of the flexible film 20 and can hold the flexible film 20 (and additional interior components) within the key fob 10. In some embodiments, the flexible film 20 can be joined to an interior surface of the upper housing 12*b* (e.g., the rim 71) in any of the manners described above, such as by using adhesive bonding, laminating, or another suitable method. After the flexible film 20 is installed in the upper housing 12*b*, the spacer layer 72 can be joined to an interior surface of the flexible film 20 using adhesive bonding material, or by another suitable method (including those described above in connection with the flexible film-to-lid attachment methods of earlier-described embodiments). In some embodiments, the flexible film 20 and the spacer layer 72 are joined before installing the components within the upper housing 12*b*. For example, the flexible film 20 can be joined with the spacer layer 72 by adhesive bonding or another suitable method. Once the flexible film 20 and the spacer layer 72 are assembled, the resulting assembly can be placed within the upper housing 12*b*.

After the flexible film 20 and the spacer layer 72 are installed in the upper housing 12*b*, the PCB 14 can be installed. In some embodiments, the PCB 14 can be joined to the spacer layer 72 by adhesive bonding or another suitable method. Also in some embodiments, the flexible film 20, spacer layer 72, and PCB 14 can be assembled together prior to installation within the upper housing 12*b* as a single unit. Next, the lower housing 12*a* can be joined with the upper housing 12*b*, and the battery 26 and the battery access door 28 can be installed. As noted above, the lower housing 12*a* and the upper housing 12*b* can be laser welded, for example, by passing a laser through a portion of the flexible film 20 and the spacer layer 72. In other embodiments, the lower housing 12*a* and the upper housing 12*b* can be joined using a snap or force fit, by adhesive, or another suitable method. In some embodiments, if the lower housing 12*a* includes standoffs on an interior portion to provide supporting surfaces for the PCB 14, the standoffs can be aligned with the PCB 14 when the lower housing 12*a* is joined with the upper housing 12*b*. Adhesive bonding can also be used to join the PCB 14 with the standoffs. It should be understood that in addition to or in place of using adhesive bonding or another similar methods, one or more of the components of the key fob 10 can be assembled using a force or pressure fit. For example, a force provided by the lower housing 12*a* joined with the upper housing 12*b* can be applied to the internal components of the key fob 10 to hold all or a subset of the components in place within the key fob 10. It should be noted that the interior components and configuration described with respect to the embodiment of FIGS. 11*a*, 11*b* and 12 can also be used with other exterior key fob configurations, such as the configurations described above with respect to FIGS. 1, 4*b*, 8, and 9. Similarly, the exterior fob components and configuration described with respect to the embodiment of FIGS. 11*a*, 11*b*, and 12 can also be used with other interior components and configurations, such as the configurations described above with respect to FIGS. 1-6, 7, and 10.

Figure 13:
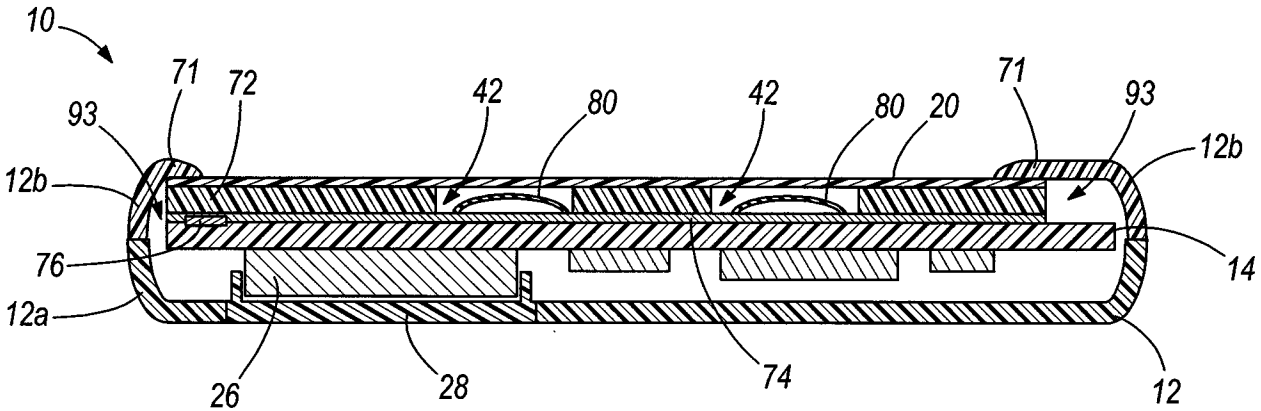
FIG. 13 is a cross-sectional view of a key fob according to another embodiment of the present invention.
Figure 14:
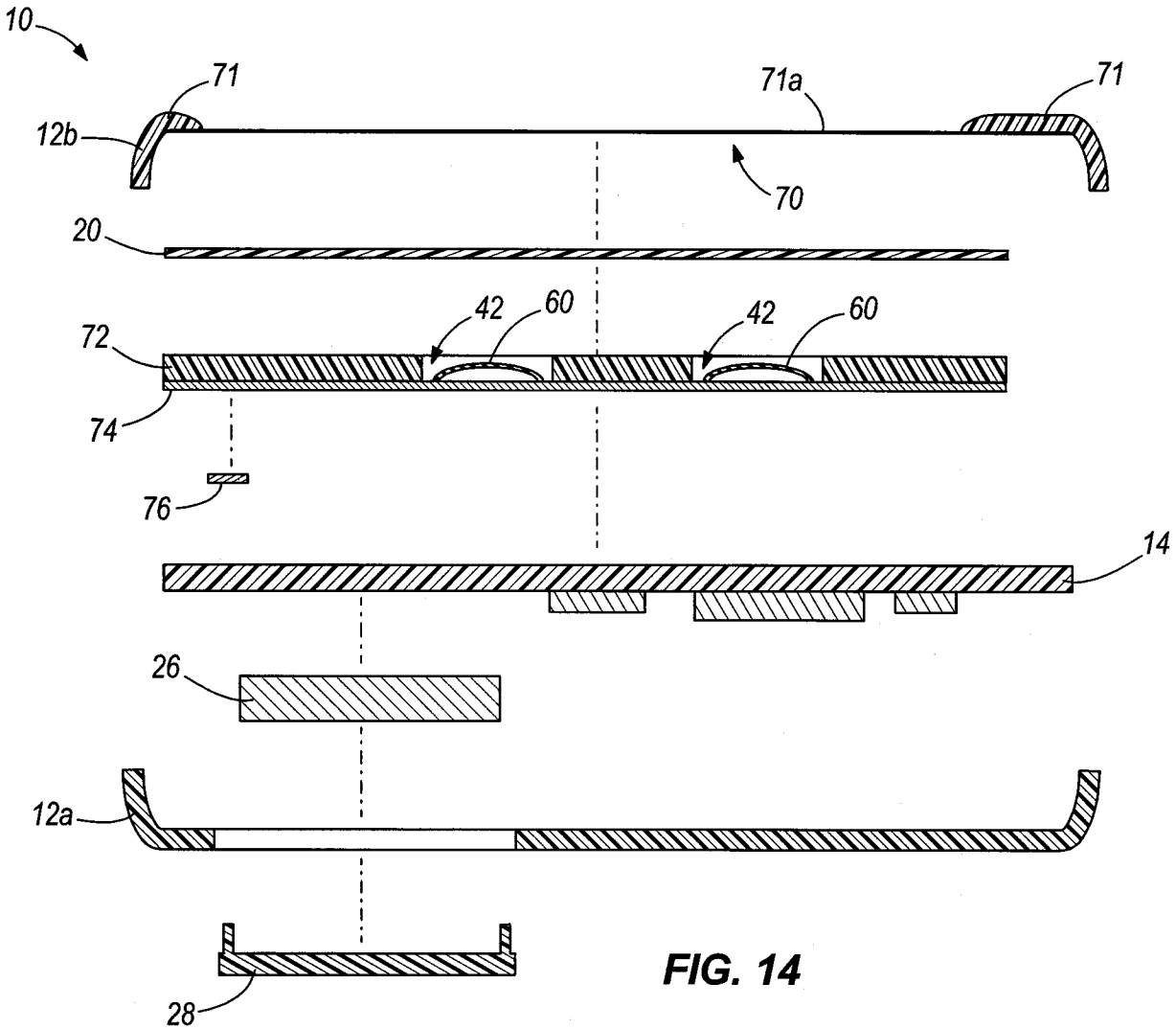
FIG. 14 is an exploded cross-sectional view of the key fob of FIG. 13.

FIGS. 13 and 14 illustrate cross-sectional views of a key fob 10 according to a further embodiment of the invention. In some embodiments, the exterior of the key fob 10 of FIGS. 13 and 14 is similar to the exterior of the key fob 10 illustrated in FIG. 11*a*. It should be understood, however, that the interior components of the key fob 10 illustrated in FIGS. 13 and 14 can be used with other exterior configurations, such as the configurations described above with respect to FIGS. 1, 4*b*, 8, and 9.

Figure 15:
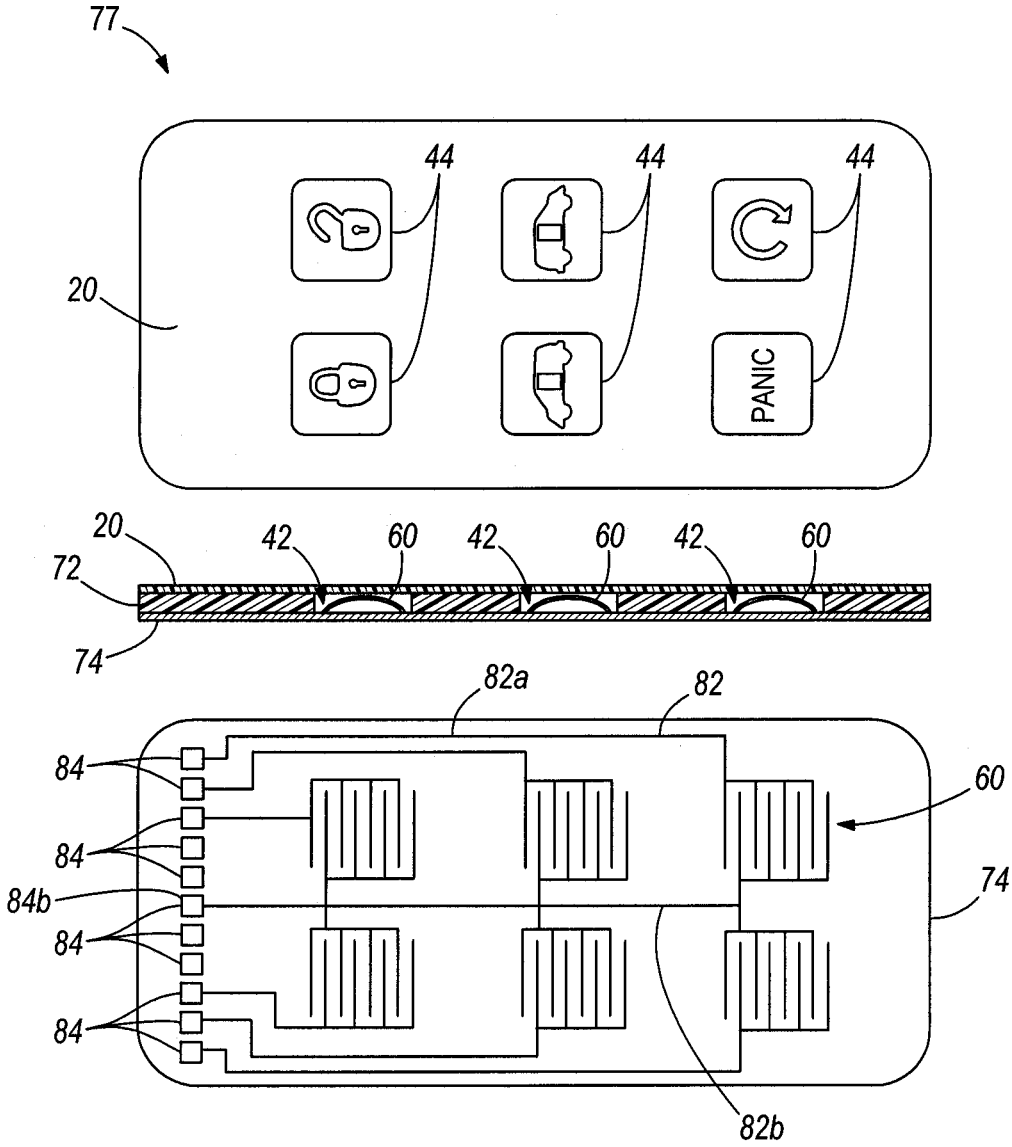
FIG. 15 are views of an assembly of the flexible film and flexible circuit included in the key fob of FIGS. 13 and 14.

As shown in FIGS. 13 and 14, the illustrated key fob 10 includes an upper housing 12*b*, a flexible film 20, a spacer layer 72, a flexible circuit 74 including one or more switches, one or more connectors 76, a PCB 14, a lower housing 12*a*, a battery 26, and a removable battery access door 28. As described above with respect to FIGS. 11*a*, 11*b* and 12, the spacer layer 72 defines one or more apertures 42 for receiving a switch 60. However, as shown in FIGS. 13 and 14, rather than or in addition to placing switches (e.g., tact or dome switches) on the PCB 14, the flexible circuit 74 includes one or more switches 60. For example, FIG. 15 is an exploded cross-sectional view of an assembly 77 of the flexible film 20 and the flexible circuit 74 of FIGS. 13 and 14 according to an embodiment of the present invention. As shown in FIG. 15, the flexible circuit 74 can include one or more switches 60 (e.g., a snap dome switch, a tact switch, a tactless membrane switch, and the like) that align with the apertures 42 in the spacer layer 72. Therefore, a user can actuate a switch 60 on the flexible circuit 74 by applying a force to a contact surface 44 on the flexible film 20, which flexes within one of the apertures 42 defined in the spacer layer 72 and actuates the switch 60.

In some embodiments, the flexible circuit 74 is die-cut or otherwise stamped, punched, or cut from a sheet of flexible material (e.g., plastic). The flexible material can include multiple layers. For example, the switches 60 can be positioned between two or more layers of flexible material. As shown in FIG. 15, each switch 60 also includes at least two electrical traces 82 (e.g., a power or signal trace 82*a* and a ground trace 82*b*). Like the switches 60, each electrical trace 82 can be positioned between two or more layers of flexible material. In some embodiments, the electrical traces 82 are constructed by printing or providing conductive material on the surface of a layer of flexible material.

As shown in FIG. 15, each electrical trace 82 can end at a contact patch 84. Each contact patch 84 provides an external electrical connection point or terminal for the electrical traces 82 on the flexible circuit 74. Therefore, each switch 60 on the flexible circuit 74 can be associated with at least one contact patch 84. Accordingly, each contact patch 84 can be associated with a particular function to be executed when the user actuates a particular switch 60 on the key fob 10. For example, a first contact patch 84 on the flexible circuit 74 can be associated with unlocking a vehicle door and a second contact patch 84 can be associated with unlocking the vehicle door. As shown in FIG. 15, the flexible circuit 74 can also include a common ground electrical trace 82*b* and an associated common ground contact patch 84*b*.

In some embodiments, the contact patch 84 for each electrical trace 82 on the flexible circuit 74 can be positioned within a common location. For example, as shown in FIG. 15, each contact patch 84 can be positioned along a common edge of the flexible circuit 74 (e.g., to one common side of the key fob 10), or can be positioned in any other common area of the flexible circuit 74 (e.g., a middle portion of the key fob 10). It should be understood that the flexible circuit 74 can include additional or fewer contact patches 84 than those illustrated in FIG. 15.

Figure 16:
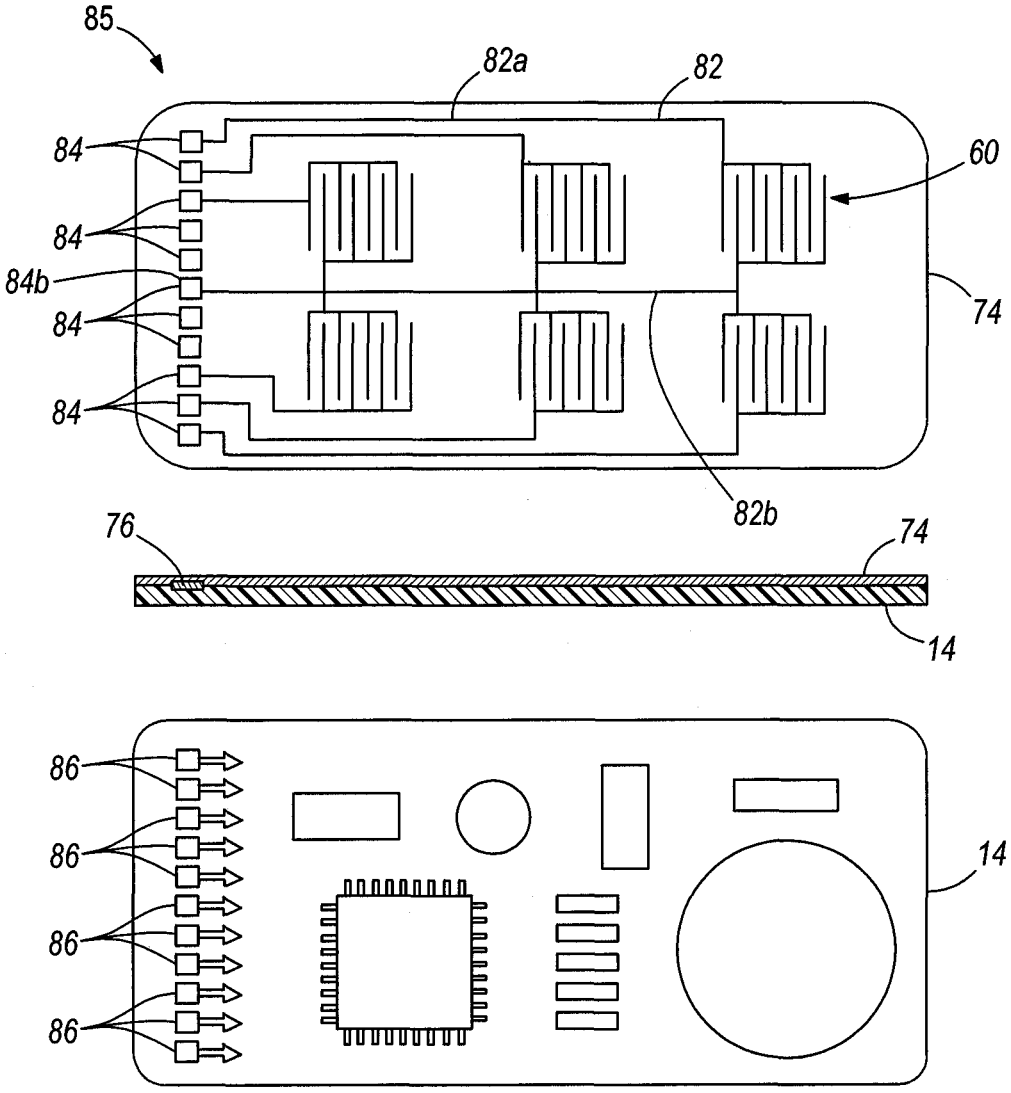
FIG. 16 are views of an assembly of a flexible circuit and a PCB included in the key fob of FIGS. 13 and 14.

FIG. 16 illustrates an assembly 85 including the flexible circuit 74 and the PCB 14 included in the key fob 10 of FIGS. 13 and 14 according to an embodiment of the present invention. As shown in FIG. 16, the contact patches 84 of the flexible circuit 74 are connected to contact patches 86 on the PCB 14 through one or more connectors 76. Similar to the contact patches 84 of the flexible circuit 74, each contact patch 86 on the PCB 14 can be associated with a particular function to be executed when a user actuates a particular switch 60. Although not shown in FIG. 16, the contact patches 86 on the PCB 14 are connected to electrical traces within the PCB 14 that carry any electrical signals received on the contact patches 86 to the proper components (e.g., the controller) installed in the PCB 14.

In some embodiments, the contact patches 86 on the PCB 14 can be positioned in the same common location as the contact patches 84 of the flexible circuit 74. For example, as shown in FIG. 16, the contact patches 86 can be positioned along a common edge of the PCB 14. Similarly, the contact patches 86 on the PCB 14 can be positioned in a similar order as the contact patches 84 of the flexible circuit 74. For example, a first contact patch on the edge of both the flexible circuit 74 and the PCB 14 can be associated with the same function, such as locking a vehicle door, unlocking a vehicle door, and the like.

As shown in FIG. 16, the connector 76 can be positioned between the flexible circuit 74 and the PCB 14. The connector 76 generally connects one or more contact patches 84 of the flexible circuit 74 with corresponding contact patches 86 on the PCB 14. In some embodiments, the connector 76 includes one or more elastomeric connectors, such as those manufactured by Fujipoly America Corporation® of Carteret, N.J. under the name Zebra® Elastomeric Connector. In other embodiments, the connector 76 is an electrically conductive adhesive transfer tape, such as those manufactured by 3M Corporation® of St. Paul, Minn. Other types of connectors 76 are possible, and fall within the spirit and scope of the present invention.

The connector 76 provides redundant electrical paths for connecting electrical components. For example, in some embodiments, the connector 76 includes a plurality of alternating conductive and non-conductive (i.e., insulating) sections or paths. When the connector 76 is joined with an electrical component, if a conductive section of the connector 76 aligns with an electrical path or terminal of the electrical component, the connector 76 passes any signal received on the electrical terminal of the electrical component through the aligned conductive section. In this sense, when the connector 76 is positioned between the flexible circuit 74 and the PCB 14, the connector 76 passes any electrical signals received from contact patches 84 on the flexible circuit 74 that align with any of its conductive sections to the contact patches 86 on the PCB 14 that also align with the same conductive sections.

In some embodiments, the connector 76 is self-adhesive, and is pressure-activated. Therefore, the connector 76 can be joined to the flexible circuit 74 and the PCB 14 through a pressure fit that activates the adhesive. Also, elastomeric connectors 76 (described above) can be used to bridge gaps between the flexible circuit 74 and the PCB 14, as they can have any shape and thickness desired. The self-adhesive feature of many transfer tape connectors and elastomeric connectors can increase the speed and efficiency of assembling the key fob 10 and, consequently, can reduce the cost of the key fob 10. Similarly, in some embodiments, the connector 76 can include a greater number of alternating conductive and non-conductive sections than the number of contact patches 84, 86 such that multiple conductive sections can align with a contact patch 84 or 86. This feature can increase the ease of assembling the key fob 10, because as long as one conductive section of the connector 76 aligns with a single contact patch 84 on the flexible circuit 74 and the corresponding contact patch 86 on the PCB 14, an electrical connection is established between the flexible circuit 76 and the PCB 14. Therefore, some degree of mismatch between the flexible circuit 74, the connector 76, and the PCB 14 can be tolerated during assembly and afterwards (e.g., if components of the key fob 10 shift).

As described above with respect to FIGS. 11*a*, 11*b* and 12, by die-cutting, stamping, punching, or otherwise cutting the spacer layer 72, the number and locations of contact surfaces 44 can be varied relatively easily and inexpensively. Similarly, by combining the spacer layer 72 with a die-cut flexible circuit 74, the number and locations of the associated switches can also be easily and inexpensively modified. Furthermore, by providing a separate, easily changeable flexible circuit 74, a common PCB 14 can generally be used in a key fob 10 even as the number and/or locations of contact surfaces 44, apertures 42, and associated switches 60 changes. As shown in FIGS. 13 and 14, the switches 60 can be removed from the PCB 14 by placing them on the flexible circuit 74. This feature can further lower the cost of the key fob 10. Another aspect of the embodiment of FIGS. 13-16 is the increased ability to easily select the number of positions of the switches 44 as needed without changing the PCB 14. As with the embodiment of FIG. 17 described below, the use of the connector 76 and the location of the switches 60 on the flexible circuit enables this advancement.

Figure 17:
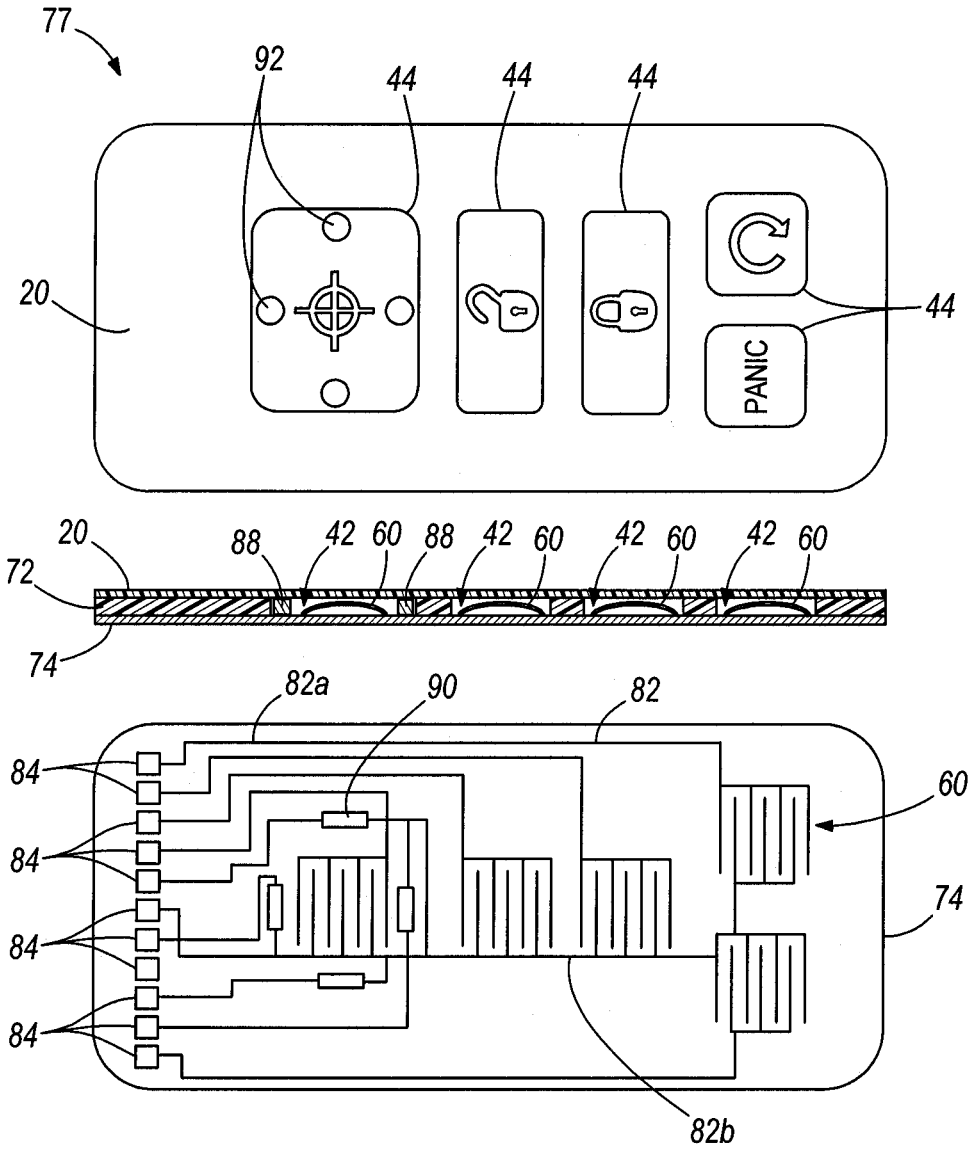
FIG. 17 are views of an assembly of a flexible film and a flexible circuit included in the key fob of FIGS. 13 and 14, according to another embodiment of the present invention.

FIG. 17 illustrates an alternative assembly 77 of the flexible film 20 and flexible circuit 74 for the key fob of FIG. 13 according to another embodiment of the present invention. As shown in FIG. 17, the flexible circuit 74 can include one or more light emitting diodes ("LEDs") 88. The LEDs 88 can be positioned on the flexible circuit 74, and can be located between two or more sheets of flexible material and/or can be surface-mounted on the flexible circuit 74. As shown in FIG. 17, in some embodiments the flexible circuit 74 can include one or more LEDs 88 around one or more switches 60. In other embodiments, the flexible circuit 74 can include one or more LEDs 88 positioned separate from a switch 60. As shown in FIG. 17, the flexible film 20 can include a corresponding LED surface 92 for one or more LEDs 88. In some embodiments, the flexible film 20 can include a LED surface 92 similar in size to a single LED 88. In other embodiments, the flexible film 20 can include a LED surface 92 smaller than or greater than the size of a single LED 88. The LED surface 92 is back-lit when the LED 88 is illuminated. In some embodiments, the LED surface 92 can be stylized in a manner different from other portions of the flexible film 20. For example, the LED surface 92 can be substantially transparent, can be colored, and/or can include a graphic or text.

As shown in FIG. 17, similar to the switches 60, the LEDs 88 can include electrical traces 82 ending at contact patches 84. As described above, the contact patches 84 are connected to contact patches 86 on the PCB 14 through the connector 76. Therefore, the PCB 14 can control when one or more of the LEDs 88 are illuminated. The LEDs 88 can operate in various manners. For example, an LED 88 can be illuminated when a switch 60 is actuated. Therefore, one or more LEDs 88 can alert a user that he or she has actuated a switch 60 on the key fob 10. In other embodiments, the key fob 10 can receive feedback from the vehicle and can display the feedback to the user using the LEDs 88. For example, if the user actuates the "lock" switch 60 on the key fob 10, the key fob 10 can transmit a "lock" signal to the vehicle and can wait to receive a "lock confirmed" signal from the vehicle. The vehicle can generate and transmit a "lock confirmed" signal once it locks one or more doors (e.g., sends a lock signal to a lock controller) and/or once it verifies that the one or more doors have actually locked (e.g., receives signals from one or more sensors). Once the key fob 10 receives a "lock confirmed" signal, the key fob 10 can illuminate one or more of the LEDs 88. Therefore, the key fob 10 can participate in two-way communication with the vehicle and can present feedback information to a user.

Figure 18:
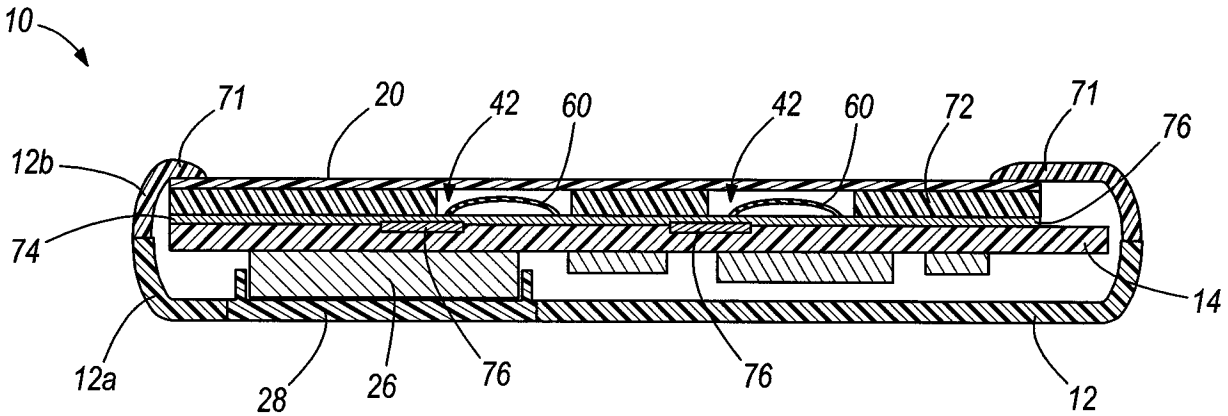
FIG. 18 is a cross-sectional view of a key fob according to yet another embodiment of the present invention.
Figure 19:
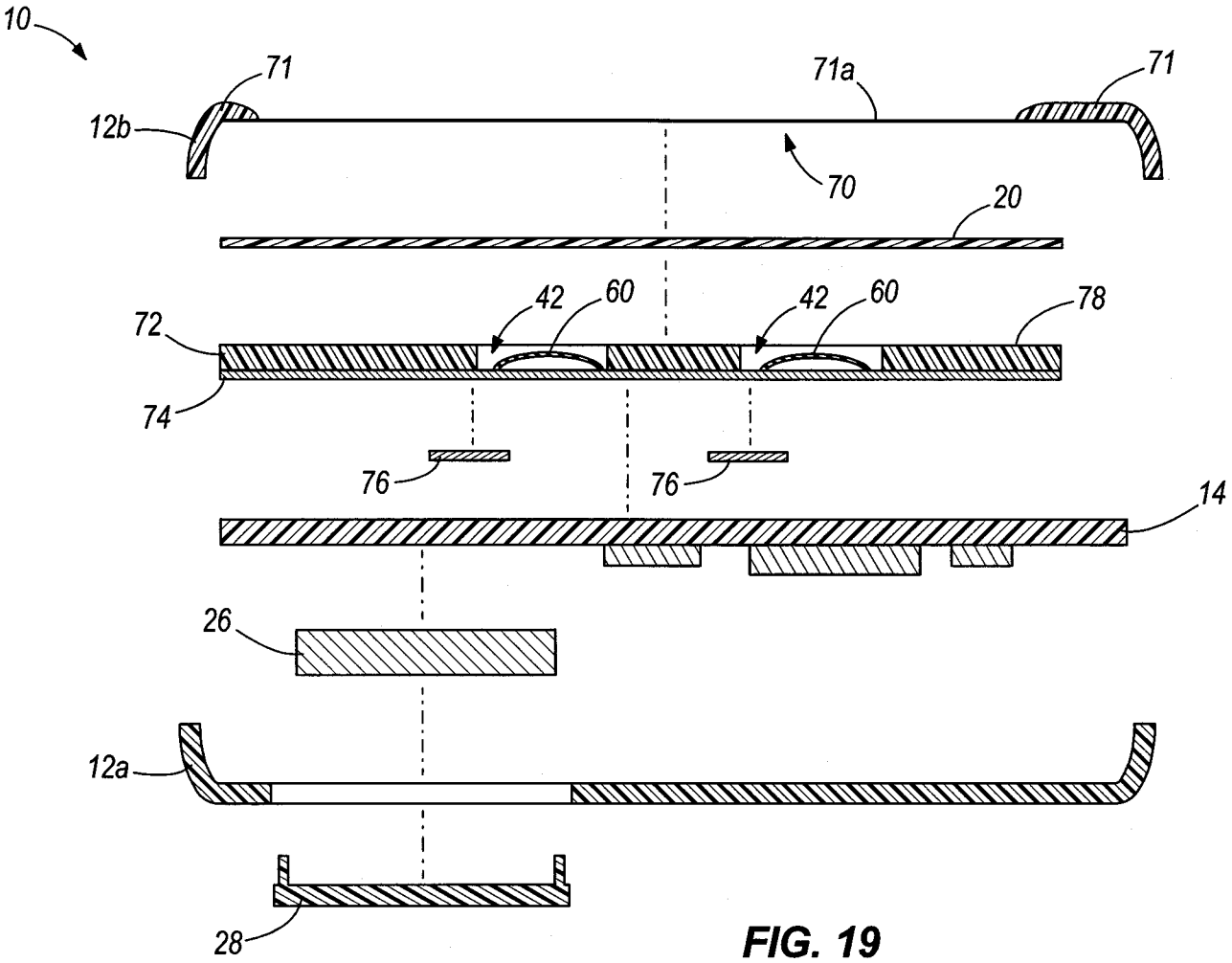
FIG. 19 is an exploded cross-sectional view of the key fob of FIG. 18.

It should be understood that, in some embodiments, multiple connectors 76 can be used to connect the flexible circuit 74 and the PCB 14. For example, as shown in FIGS. 18 and 19, a connector 76 can be used for each contact patch 84 on the flexible circuit 74. Using this configuration, each contact patch 84 on the flexible circuit 74 can be connected to a contact patch 86 on the PCB 14 where a corresponding switch 80 would be if not provided in the flexible circuit 74. Therefore, in some embodiments, this configuration allows the flexible film 20, the spacer layer 72, and the flexible circuit 74 to be used in a key fob without substantially modifying the PCB 14 previously used in the key fob. Also, regardless of whether one connector 76 is used or whether multiple connectors 76 are used, the number of positions of the switches 44 and LEDs 88 can be changed in many embodiments without changing the PCB 14.

As described above with respect to FIG. 12, the key fob 10 illustrated in FIGS. 13-17 can be assembled almost entirely in a single position. For example, as described above, the key fob 10 can be back loaded or assembled by initially placing the flexible film 20 into the upper housing 12*b*. As noted above, the rim 71 of the upper housing 12*b* can cover a portion of the flexible film 20 and hold the flexible film 20 (and additional interior components) within the key fob 10. In some embodiments, the flexible film 20 can be joined to an interior surface of the upper housing 12*b* (e.g., the rim 71) using adhesive bonding, laminating, or another suitable method. After the flexible film 20 is installed in the upper housing 12*b*, the spacer layer 72 can be joined to an interior surface of the flexible film 20 using adhesive bonding or another similar method. The flexible circuit 74 can be joined to an interior surface of the spacer layer 72 using adhesive bonding or by another suitable method. Next, the one or more connectors 76 and the PCB 14 can be installed in the upper housing 12*b*. As noted above, in some embodiments, the one or more connectors 76 include a self-adhesive that is actuated by pressure applied by the flexible circuit 74 and the PCB 14. The PCB 14 can also be joined to the flexible circuit 74 using adhesive bonding or by another suitable method.

In some embodiments, the flexible film 20, the spacer layer 72, and the flexible circuit 74 can be constructed as an assembly before installing the components in the upper housing 12*b* as a single integral unit. For example, the flexible film 20, the spacer layer 72, and the flexible circuit 74 can be joined using a laminating process or by another suitable method. Once constructed, the assembly can be placed within the upper housing 12*b*. In some embodiments, the assembly (i.e., the flexible film 20, the spacer layer 72, and the flexible circuit 74) can be joined to the upper housing 12*b* using adhesive bonding, or in any other suitable manner. For example, as shown in FIG. 13, an adhesive can be applied in corners 93 within the upper housing 12*b* adjacent the assembly. In some embodiments, the one or more connectors 76 can also be attached to the assembly using adhesive bonding or by another suitable method before the assembly is installed in the upper housing 12*b*.

After the flexible film 20, the spacer layer 72, the flexible circuit 74, the one or more connectors 76, and the PCB 14 are installed in the upper housing 12*b*, the lower housing 12*a* can be joined with the upper housing 12*b*, and the battery 26 and the battery access door 28 can be installed. As noted above, the lower housing 12*a* and the upper housing 12*b* can be laser welded by passing a laser through a portion of the flexible film 20, the spacer layer 72, and/or the flexible circuit 74. In other embodiments, the lower housing 12*a* and the upper housing 12*b* can be joined using a snap or force fit, an adhesive, or another suitable method. In some embodiments, if the lower housing 12*a* includes standoffs on an interior portion to provide supporting surfaces for the PCB 14, the standoffs can be aligned with the PCB 14 when the lower housing 12*a* is installed. Adhesive bonding can also be used to join the PCB 14 with the standoffs. It should be understood that in addition to or in place of using adhesive bonding or other similar connection methods, one or more of the components of the key fob 14 can be assembled using a force or pressure fit. For example, force provided by the lower housing 12*a* joined with the upper housing 12*b* can be applied to the internal components of the key fob 10 to hold all or a subset of the components in place.

Figure 20A:
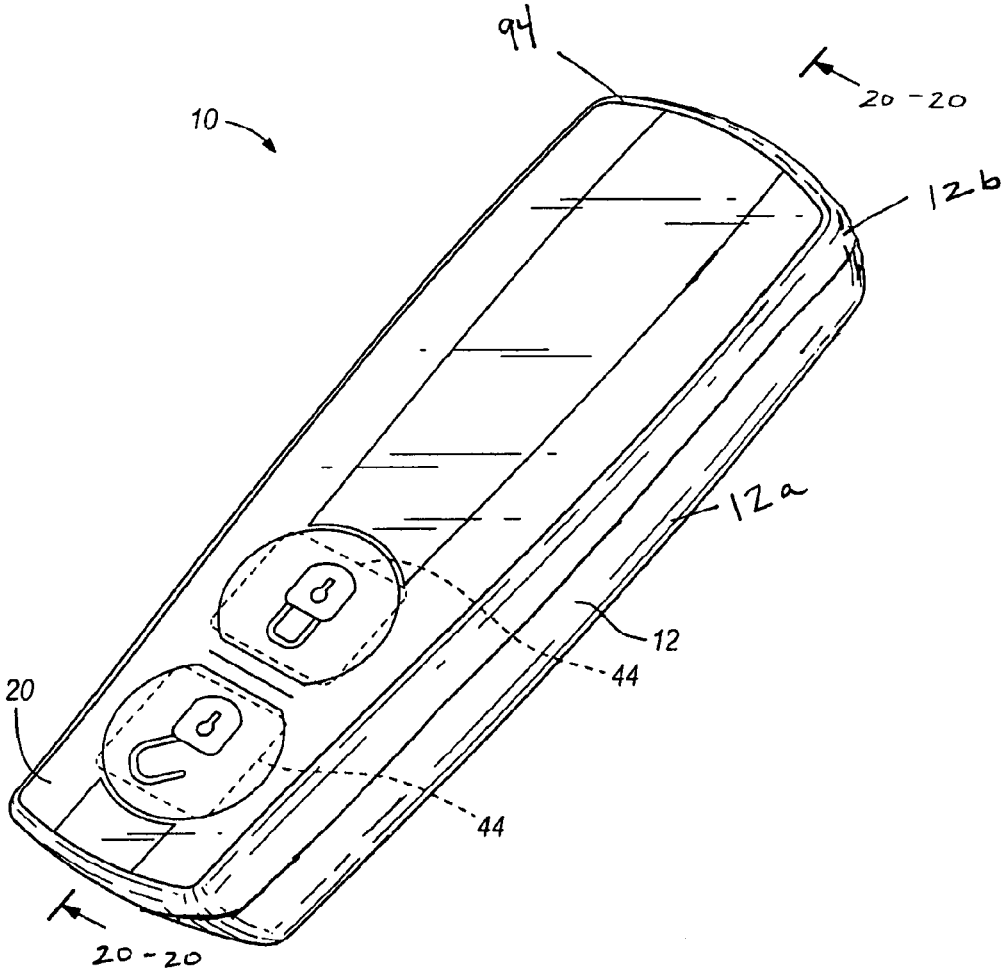
FIG. 20*a* is a perspective view of a key fob according to another embodiment of the present invention.
Figure 20B:
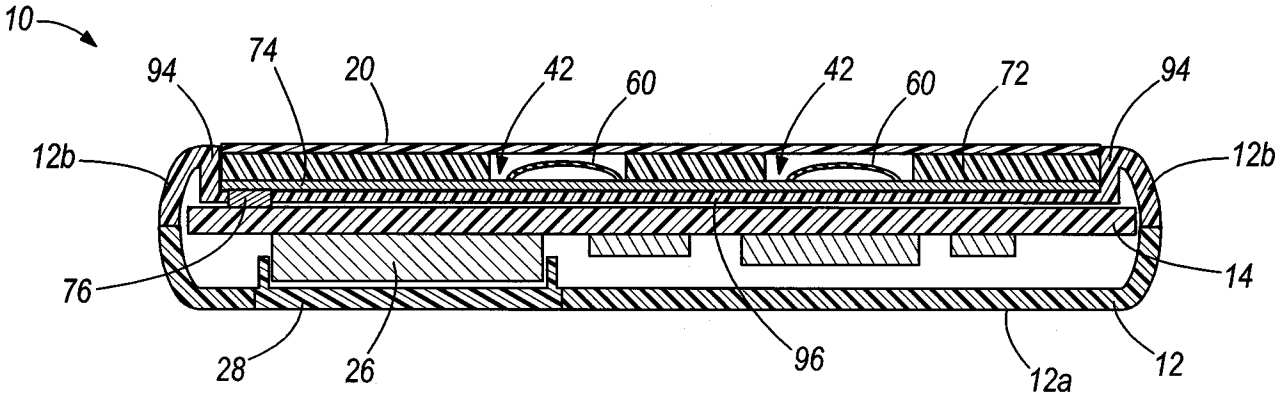
FIG. 20*b* is a cross-sectional view of the key fob of FIG. 20*a*, taken along line 20-20 of FIG. 20*a*.

FIG. 20*a* is a perspective view of a key fob 10 according to another embodiment of the present invention. As shown in FIG. 20*a*, the illustrated key fob includes a flexible film 20 and a housing 12 including a lower housing 12*a* and an upper housing 12*b*. As also shown in FIG. 20*a*, rather than having a rim 71 overlapping an outer edge of the flexible film 20 as described above with respect to FIG. 11*a*, the upper housing 12*b* illustrated in FIG. 20*a* includes a frame 94 surrounding an outer edge of the flexible film 20. As shown in FIG. 20*b*, the frame 94 is at substantially the same height as the flexible film 20. It should be understood, however, that the frame 94 can be constructed to be at a greater or lesser height than the height of the flexible film 20. For example, the height of the flexible film 20 can be lower than the height of the frame 94 in order to reduce the opportunity for an edge of the flexible film 20 to catch on external objects and potentially being inadvertently removed and/or damaged. In some embodiments, the frame 94 can also include a lip (not shown) that overlaps an outer edge of the flexible film 20 to further prevent the flexible film 20 from being inadvertently removed and/or damaged.

Figure 21:
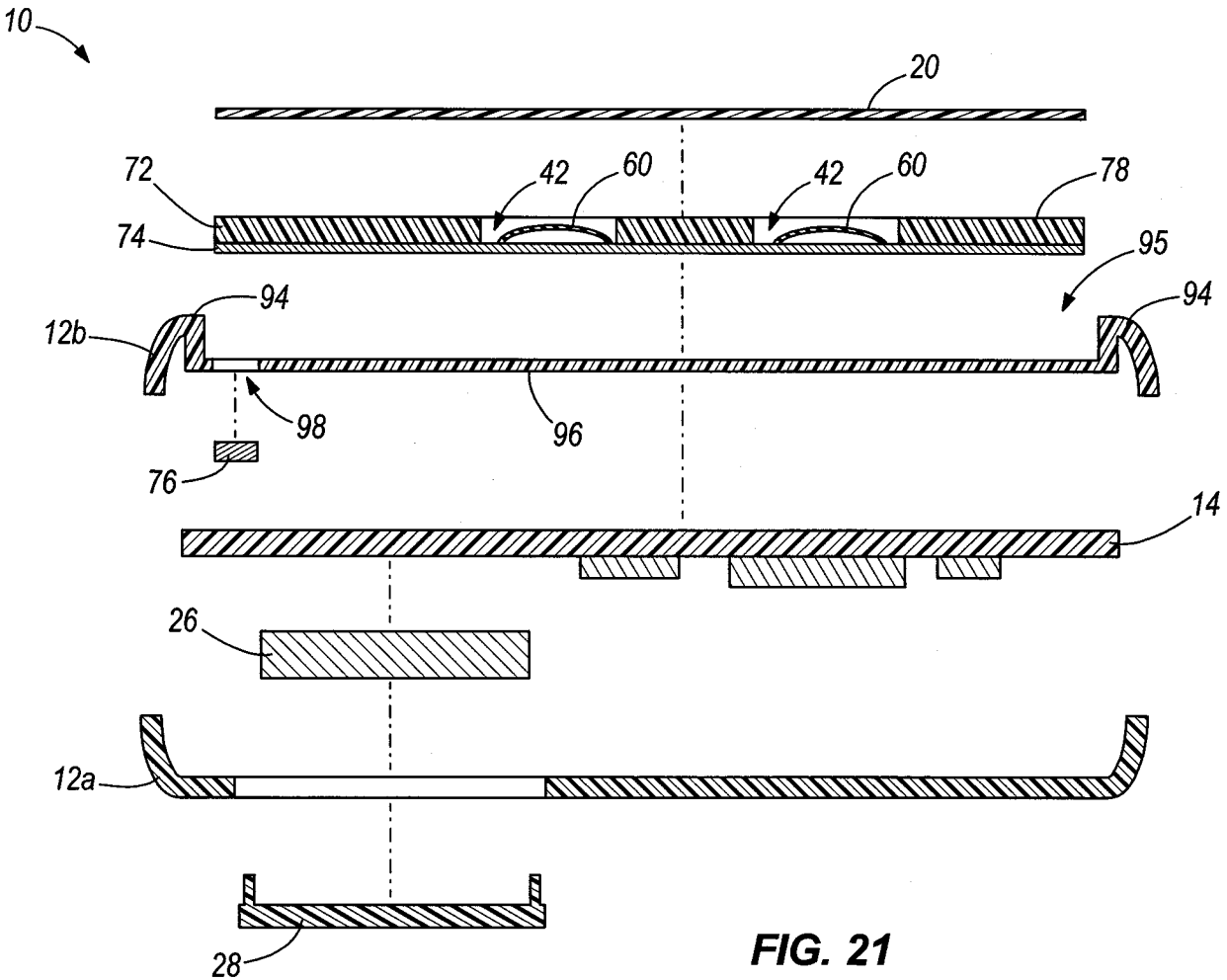
FIG. 21 is an exploded cross-sectional view of the key fob of FIGS. 20*a-b*.

FIGS. 20*b* and 21 are cross-sectional views of the key fob of FIG. 20*a*, taken along line 20-20 of FIG. 20*a*. As shown in FIGS. 20*b* and 21, the illustrated key fob 10 includes an upper housing 12*b*, a flexible film 20, a spacer layer 72, a flexible circuit 74, a connector 76, a PCB 14, a battery 26, a lower housing 12*a*, and a removable battery access door 28. As described above with respect to FIGS. 13-19, the flexible film 20, the spacer layer 72, and the flexible circuit 74 define the number and locations of switches 60 and the associated contact surfaces 44 on the key fob 10. In some embodiments, because most of these components can be die-cut (e.g., rather than injection molded), they can be easily and inexpensively modified to adapt each fob for different functionality. As also described above with respect to FIGS. 13-19, a connector 76, such as an elastomeric connector, connects contact patches on the flexible circuit 74 to contact patches on the PCB 14. Therefore, in some embodiments, even as the locations and number of switches 60 on the flexible circuit 74 change, the PCB 14 does not need to change. In addition, in this configuration, the PCB 14 does not require any switches, which lowers the cost of the PCB 14.

As shown in FIG. 21, the illustrated upper housing 12*b* includes a recess 95 and a lower surface 96. The recess 95 receives the flexible film 20, the spacer layer 72, and the flexible circuit 74, which are supported by the lower surface 96. In some embodiments, the flexible circuit 74 is joined to the lower surface 96 using adhesive bonding or by another suitable method. In this sense, as compared to the rim 71 of the upper housing 12*b* of FIGS. 11*b* and 12-14, the lower surface 96 provides a large area for supporting and securing the flexible film 20, the spacer layer 72, and the flexible circuit 74 within the upper housing 12*b*.

Figure 22:
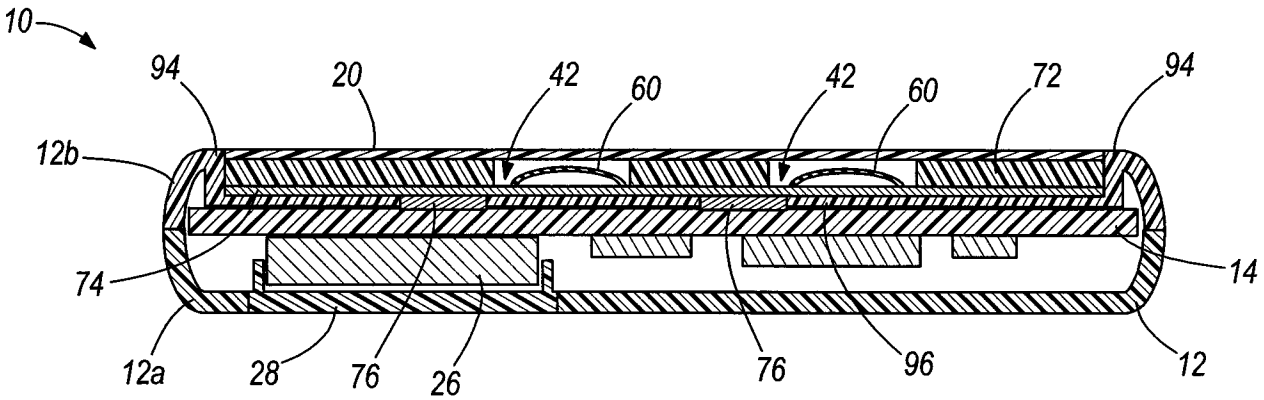
FIG. 22 is a cross-sectional view of a key fob according to another embodiment of the present invention.
Figure 23:
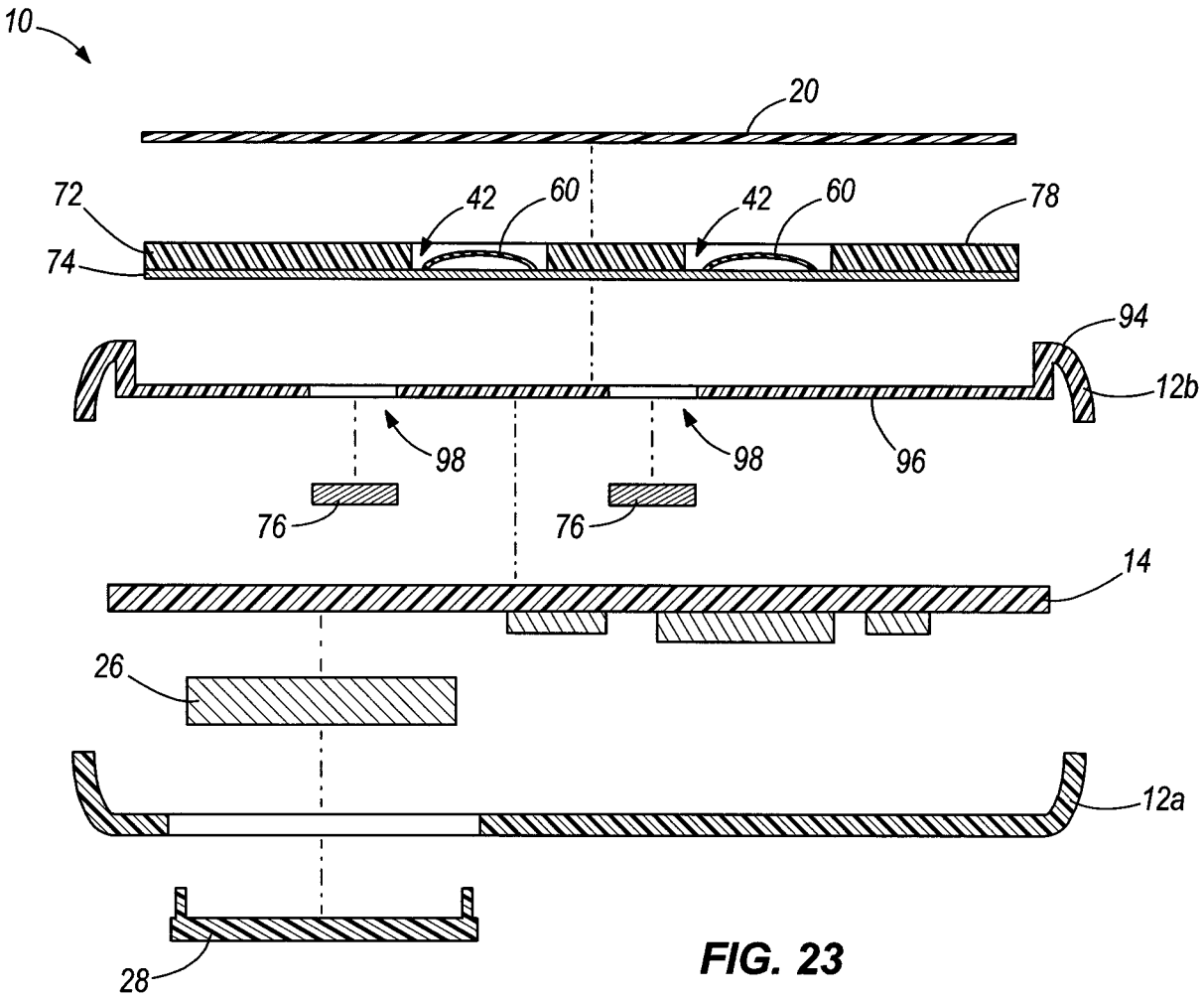
FIG. 23 is an exploded cross-sectional view of the key fob of FIG. 22.

As also shown in FIG. 21, the lower surface 96 of the upper housing 12*b* includes an opening 98. The opening 98 receives the connector 76, which electrically connects the flexible circuit 74 with the PCB 14. Therefore, in some embodiments, the contact patches on the flexible circuit 74 are aligned with the opening 98. Similarly, the contact patches on the PCB 14 are aligned with the opening 98. The connector 76 can be placed within the opening 98 to connect the contact patches of the flexible circuit 74 with the contact patches of the PCB 14. It should be understood that the opening 98 (and associated contact patches) can be positioned anywhere along the lower surface 96 of the upper housing 12*b*. Similarly, multiple openings 98 and connectors 76 can be provided to connect the flexible circuit 74 and the PCB 14. For example, as shown in FIGS. 22 and 23, in some embodiments, an opening 98 in the lower surface 96 and an associated connector 76 can be provided for each contact patch on the flexible circuit 74. Using this configuration, each contact patch on the flexible circuit 74 can be connected to a contact patch on the PCB 14 where a corresponding switch 60 would be if not provided in the flexible circuit 74. Therefore, in some embodiments, this configuration allows the flexible film 20, the spacer layer 72, and the flexible circuit 74 to be used in a key fob 10 without substantially modifying the PCB 14 previously used in the key fob 10, and permits the number and locations of switches 60 to be changed from application to application without the expense of modifying the PCB 14.

To assemble the key fob 10 illustrated in FIGS. 20*a-b* and 21-23, the flexible film 20, the spacer layer 72, and the flexible circuit 74 can be front loaded or assembled (i.e., installed from a front of the key fob 10) into the recess 95 of the upper housing 12*b*. In some embodiments, the flexible circuit 74 can be joined with the lower surface 96 of the recess 95 using adhesive bonding or by another suitable method. Therefore, once the flexible circuit 74 is installed, the spacer layer 72 can be joined to the flexible circuit 74 and the flexible film 20 can be joined to the spacer layer 72 using adhesive bonding or by another suitable method. In other embodiments, the flexible film 20, the spacer layer 72, and the flexible circuit 74 are joined before the components are installed in the recess 95. For example, the flexible film 20, the spacer layer 72, and the flexible circuit 74 can be joined using a lamination process, by adhesive bonding, or using another suitable method. The resulting assembly can then be placed within the recess 95 and joined with the upper housing 12*b* (e.g., the lower surface 96) using adhesive bonding or by another suitable method.

Once the flexible film 20, the spacer layer 72, and the flexible circuit 74 are installed in the recess 95, the one or more connectors 76 and the PCB 14 can be installed within the upper housing 12*b*. As described above, in some embodiments, the connector 76 can be self-adhesive, and can be actuated by pressure applied by the flexible circuit 74 and the PCB 14. In some embodiments, the PCB 14 can also be joined to an interior surface of the lower surface 96 of the upper housing 12*b* using adhesive bonding or by another suitable method. The lower housing 12*a* can then be joined with the upper housing 12*b*, and the battery 26 and the battery access door 28 can be installed. In some embodiments, the lower housing 12*a* and the upper housing 12*b* can be joined using a snap or force fit, by adhesive, or using another suitable method. In some embodiments, if the lower housing 12*a* includes standoffs on an interior portion to provide supporting surfaces for the PCB 14, the standoffs can be aligned with the PCB 14 when the lower housing 12*a* is installed. Adhesive bonding can also be used to join the PCB 14 with the standoffs. It should be understood that in addition to or in place of using adhesive bonding or other suitable methods, one or more of the components of the key fob 14 can be assembled using a force or pressure fit. For example, force provided by the lower housing 12*a* joined with the upper housing 12*b* can be applied to the internal components of the key fob 10 in order to hold all or a subset of the components in place.

It should also be noted that the interior components of FIGS. 20*a-b* and 21-23 can also be used with other exterior configurations, such as the configurations described above with respect to FIGS. 1, 4*b*, 8, 9, and 11*a*. Similarly, the exterior components and configuration of FIGS. 20*a-b* and 21-23 can be used with other interior configurations, such as the configurations described above with respect to FIGS. 1-6, 7, 10, 11*b*, and 12.

Figure 24:
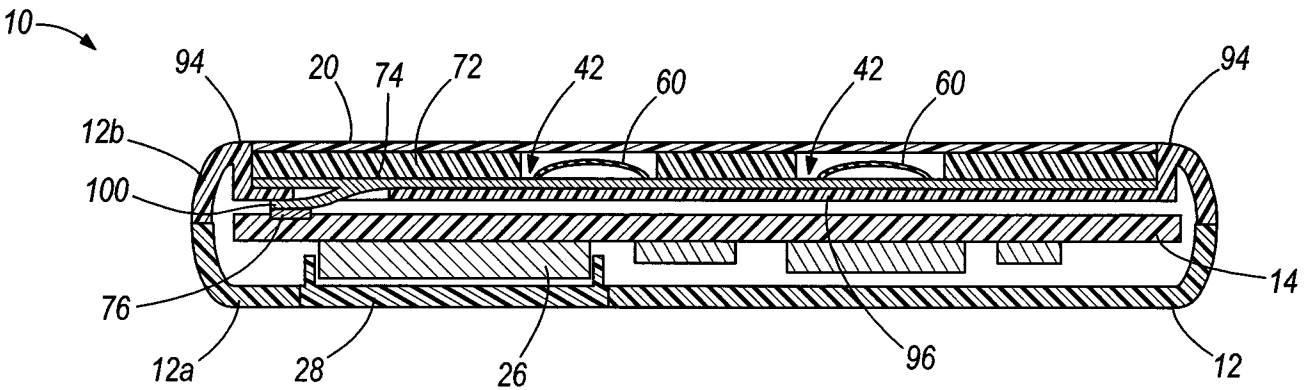
FIG. 24 is a cross-sectional view of a key fob according to another embodiment of the present invention.
Figure 25:
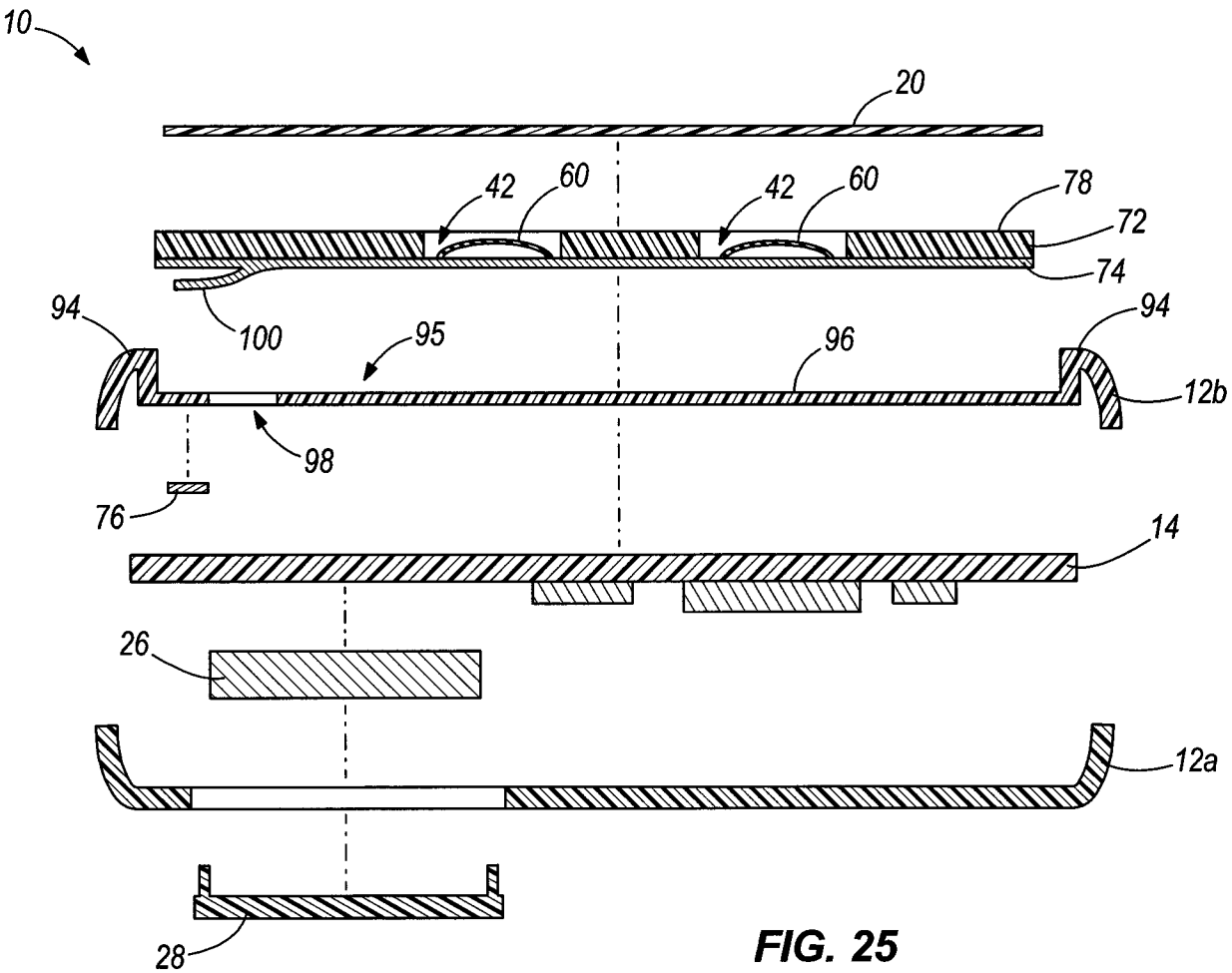
FIG. 25 is an exploded cross-sectional view of the key fob of FIG. 24.

FIGS. 24 and 25 are cross-sectional views of a key fob according to another embodiment of the present invention. In some embodiments, the exterior of the key fob 10 of FIGS. 24 and 25 is similar to the exterior of the key fob 10 illustrated in FIG. 20*a*. It should be understood, however, that the interior components of the key fob 10 illustrated in FIGS. 24 and 25 can be used with other exterior configurations, such as the configurations described above with respect to FIGS. 1, 4*b*, 8, 9, and 11*a*.

As shown in FIGS. 24 and 25, the illustrated key fob 10 includes an upper housing 12*b* including a recess 95, a lower surface 96, and an opening 98; a flexible film 20; a spacer layer 72; a flexible circuit 74 including one or more switches 60; one or more connectors 76; a PCB 14; a lower housing 12*a*; a battery 26; and a removable battery access door 28. As also shown in FIGS. 24 and 25, the illustrated flexible circuit 74 includes a trace tail 100. The trace tail 100 can be constructed of flexible material (such as that of the flexible circuit 74) and can extend from an end of the flexible circuit 74 or from any other location on the flexible circuit 74. The trace tail 100 includes all or a subset of the electrical traces of the flexible circuit 74 and the associated contact patches.

In some embodiments, the key fob 10 of FIGS. 24 and 25 can be assembled as described above with respect to FIGS. 20*a-b* and 21-23. However, the trace tail 100 can be fed through the opening 98 of the upper housing 12*b*, and the contact patches on the trace tail 100 can be connected to the contact patches on the PCB 14 using one or more connectors 76, as described above. By placing the contact patches of the flexible circuit 74 on the trace tail 100, the flexible circuit 74 no longer needs to be rigidly joined to the PCB 14. This feature can increase the speed and ease of installation, because the flexible circuit 74 no longer needs to be accurately aligned with the connector 76 and/or the PCB 14 to form a proper electrical connection. In addition, the flexible trace tail 100 can allow the PCB 14 to move with respect to the flexible circuit 74. For example, if the key fob 10 is dropped, movement of the PCB 14 will generally not cause the PCB 14 to lose its electrical connection with the flexible circuit 74 because the flexible trace tail 100 will flex and move with the PCB 14. In addition, in some embodiments, the PCB 14 can be held within the housing 12 of the key fob 10 with resilient or flexible elements, such as rubber feet. The resilient or flexible elements, combined with the flexible trace tail 100, can further allow the PCB 14 to "float" or move within the key fob 10 in order to avoid shock or damage to the PCB 14 while still maintaining an electrical connection with the flexible circuit 74. In some embodiments, the trace tail 100 also permits the use of a curved or bowed flexible circuit 74 (and associated spacer layer 72 and/or flexible film 20) to be joined to a relatively flat PCB 14.

It should be understood that, in some embodiments, the flexible circuit 74 can include multiple trace tails 100. For example, the flexible circuit 74 can include a trace tail 100 for each contact patch. In some embodiments, each trace tail 100 can have its own opening 98 in the upper housing 12*b*. In other embodiments, multiple trace tails 100 can use a common opening 98. By providing a trace tail 100 for each contact patch, each contact patch can be connected to a contact patch on the PCB 14 where a corresponding switch 60 would be if not provided in the flexible circuit 74. Therefore, in some embodiments, this configuration allows the flexible film 20, the spacer layer 72, and the flexible circuit 74 to be used in a key fob 10 without substantially modifying the PCB previously used in the design of the key fob 10.

Figure 26A:
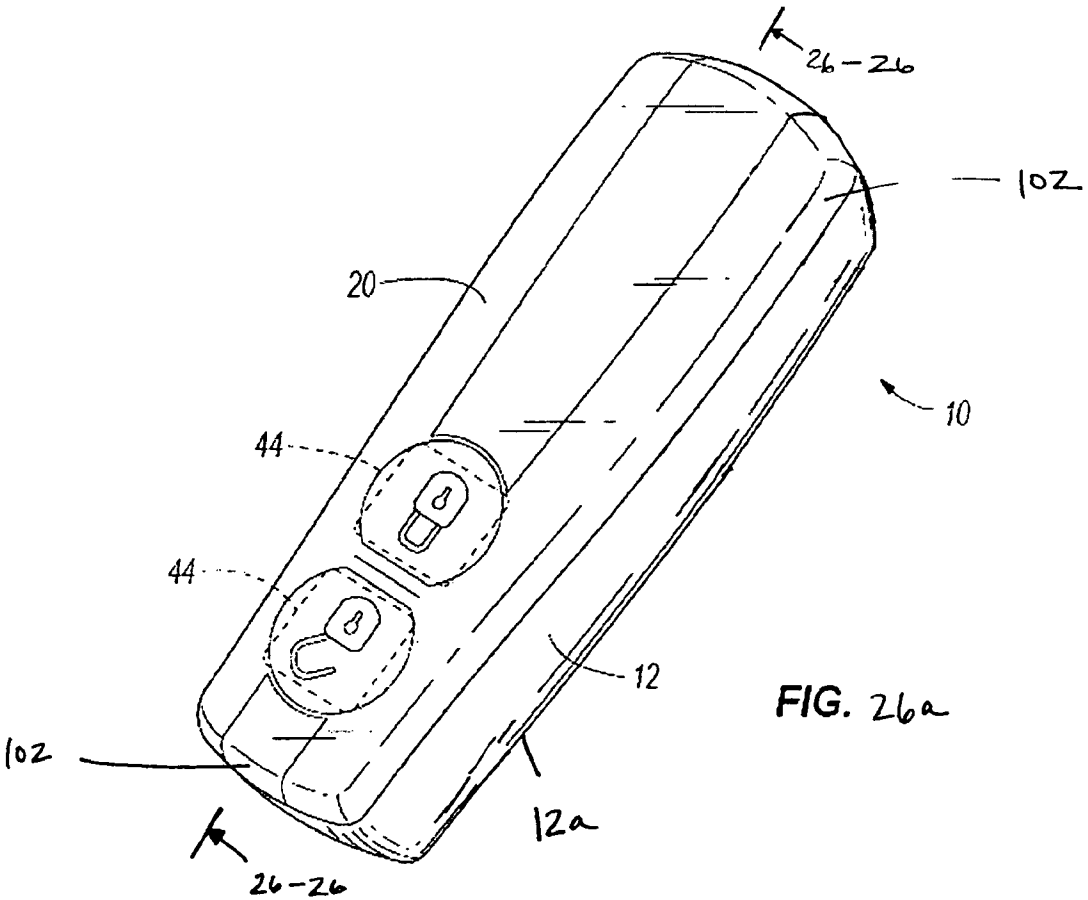
FIG. 26*a* is a perspective view of a key fob according to another embodiment of the present invention.

FIG. 26*a* is a perspective view of a key fob 10 according to another embodiment of the present invention. The illustrated key fob 10 includes a flexible film 20 including a plurality of contact surfaces 44 and a housing 12 consisting of a lower housing 12*a*. As shown in FIG. 26*a*, the flexible film 20 is thermoformed (as described above with respect to FIG. 9) to define an upper portion of the key fob 10. When thermoformed, the flexible film 20 can define one or more side surfaces 102 of the key fob 10 that join with the housing 12. As shown in the cross-sectional views of FIGS. 26*b* and 27, the flexible film 20 can be thermoformed such that the shape of the flexible film 20 substantially matches the contour of an encapsulating material 104 defining an interior of the key fob 10. Although the flexible film 20 can be thermoformed as just described, in other embodiments, other manners of forming the flexible film 20 are possible depending at least in part upon the material used for the flexible film. Such alternative manners of forming the flexible film 20 fall within the spirit and scope of the present invention.

Figure 26B:
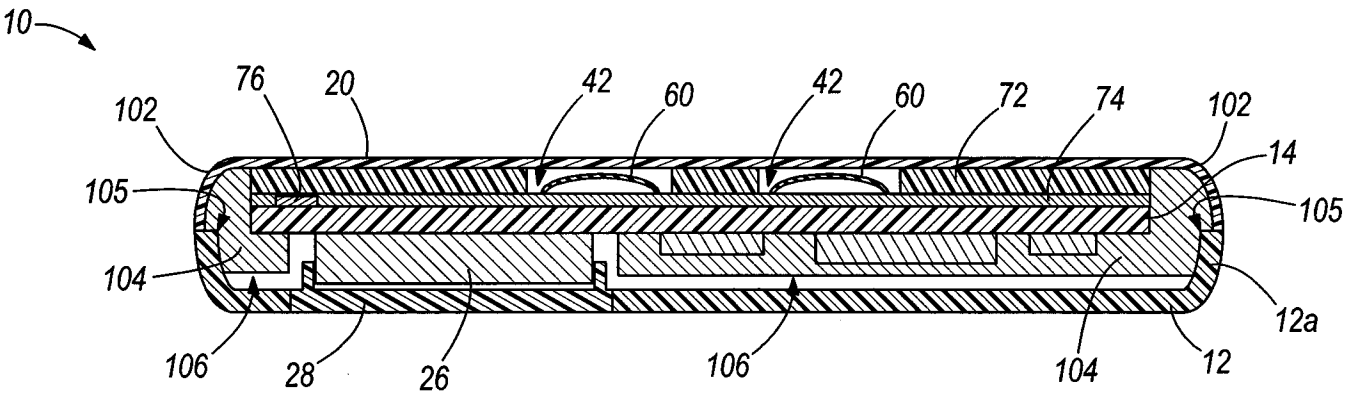
FIG. 26*b* is a cross-sectional view of the key fob of FIG. 26*a*, taken alone line 26-26 of FIG. 26*a*.
Figure 27:
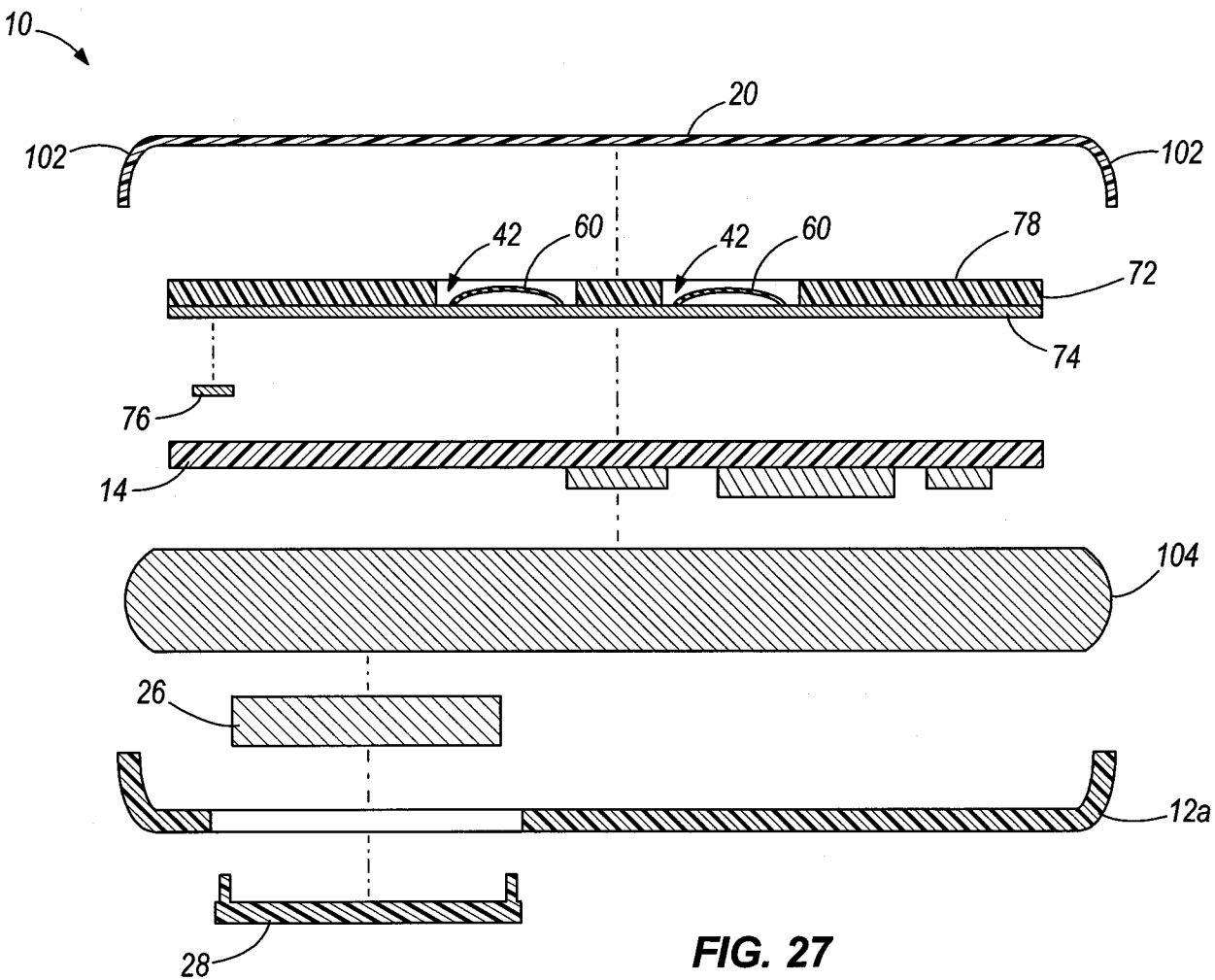
FIG. 27 is an exploded cross-sectional view of the key fob of FIGS. 26*a-b*.

As shown in FIGS. 26*b* and 27, an encapsulating material 104 can at least partially encase the spacer layer 72, the flexible circuit 74, the one or more connectors 76, and the PCB 14 within the thermoformed flexible film 20. In some embodiments, the encapsulating material 104 includes a resin, such as polyamide hot melt adhesive, that provides low-pressure molding. For example, the encapsulating material 104 can be passed under low pressure into a mold or form containing the fob components. Using low pressure encapsulation (as compared to higher-pressure encapsulation) can prevent the components of the key fob 10 from being damaged during the assembly process.

Once encapsulated, the encapsulating material 104 protects the components from dust, debris, moisture, and shock. For example, once encapsulated, the components cannot move even if the key fob 10 is dropped or strikes another surface. In addition, using the encapsulating material 104 to define an upper housing for the key fob 10 eliminates the need for a separate upper housing (such as an injection molded housing), which can have a higher tooling cost. Similarly, by forming an upper housing of the key fob 10 with the encapsulating material 104, in some embodiments the flexible film 20 no longer needs to be adhesively bonded to an upper housing. In addition, the encapsulating material 104 can eliminate adhesive bonding for joining other components of the key fob 10 (e.g., the flexible circuit 74 and the PCB 14).

To assemble the key fob 10 of FIGS. 26*a-b* and 27, the spacer layer 72, the flexible circuit 74, the one or more connectors 76, and the PCB 14 can be back loaded or assembled within the thermoformed flexible film 20 using adhesive bonding or another similar method. Once the components are assembled, the encapsulating material 104 can be injected or otherwise introduced around the components, such as within a mold or form. As shown in FIG. 26*b*, the encapsulating material 104 can fully encapsulate the components except for a connection point on the PCB 14 for the battery 26. As also shown in FIG. 26*b*, the encapsulating material 104 can also form a joint 105 that interfaces with the lower housing 12*a*. For example, the lower housing 12*a* can be joined at the joint 105 to the encapsulating material 104 and/or the thermoformed flexible film 20 using adhesive bonding or by another suitable method. Once the lower housing 12*a* and the upper housing 12*b* are joined, the battery 26 and the battery access door 28 can be installed. As described above, in some embodiments, the key fob 10 of FIGS. 26*a-b* and 27 can be assembled almost entirely in a single position (e.g., back loaded), meaning that the components do not need to be turned over until the end of the assembly, which can speed the process and lower costs.

Figure 28:
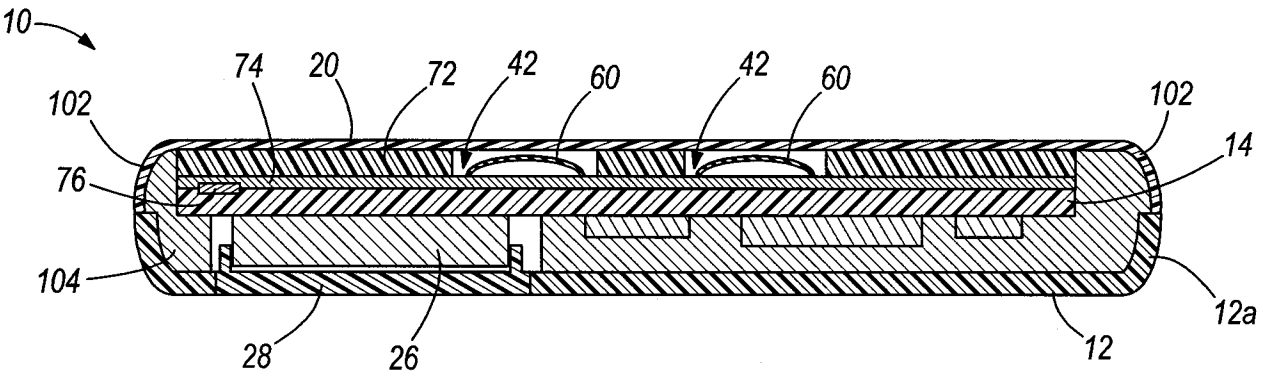
FIG. 28 is a cross-sectional view of a key fob according to another embodiment of the present invention.
Figure 29:
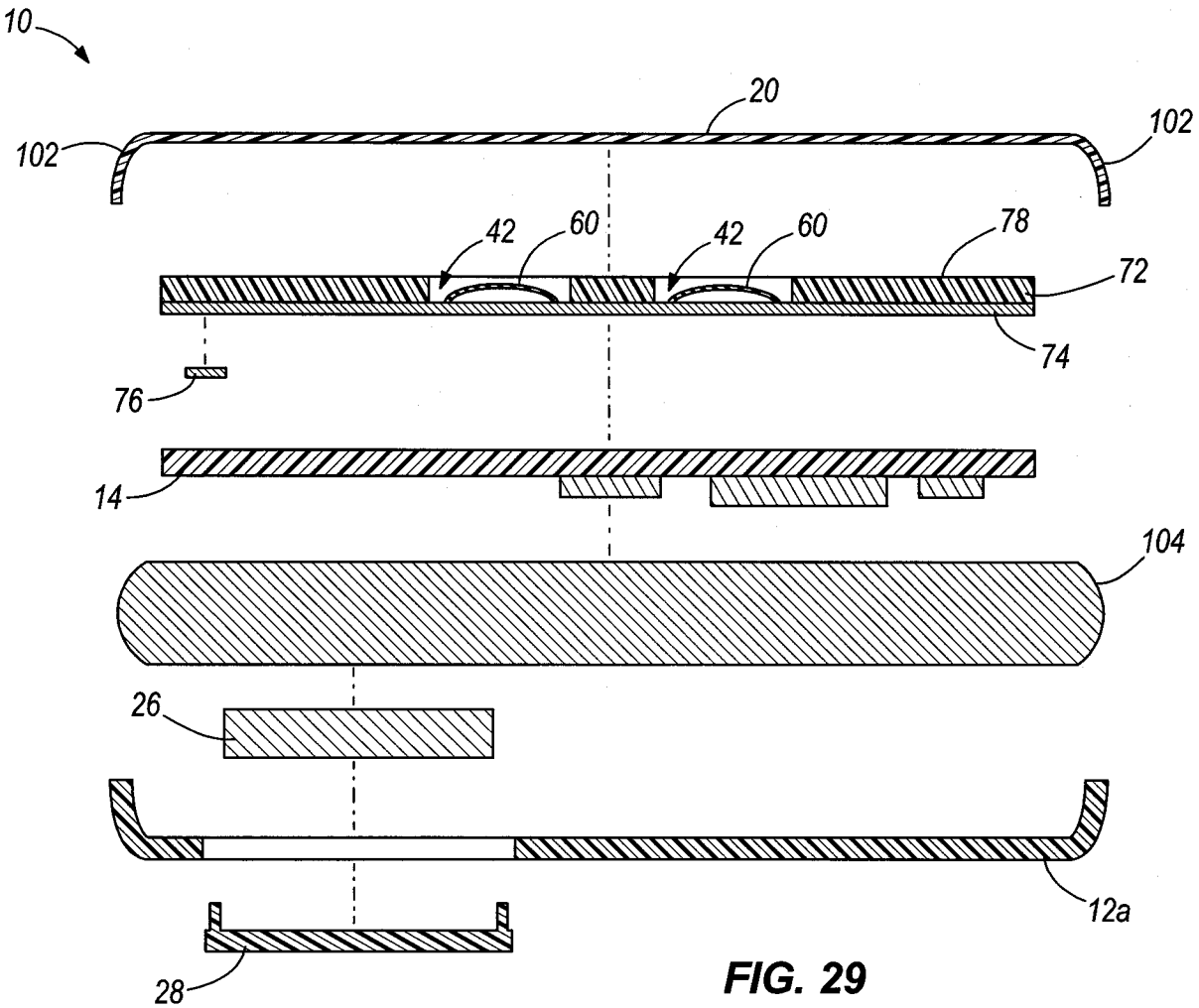
FIG. 29 is an exploded cross-sectional view of the key fob of FIG. 28.

In some embodiments, the encapsulating material 104 encases only a portion of an interior cavity of the key fob 10. For example, as shown in FIG. 26*b*, the key fob 10 can include a space 106 between the encapsulating material 104 and a portion of the lower housing 12*a*. In other embodiments, the encapsulating material 104 can fill more of the interior cavity of the key fob 10, or can fill all or substantially all of the interior cavity. For example, as shown in FIGS. 28 and 29, the encapsulating material 104 can substantially fill the interior cavity of the key fob 10. Using this configuration, the encapsulating material 104 can bind the lower housing 12*a* to the thermoformed flexible film 20 without the need for adhesive bonding or another manner of attachment.

Figure 30:
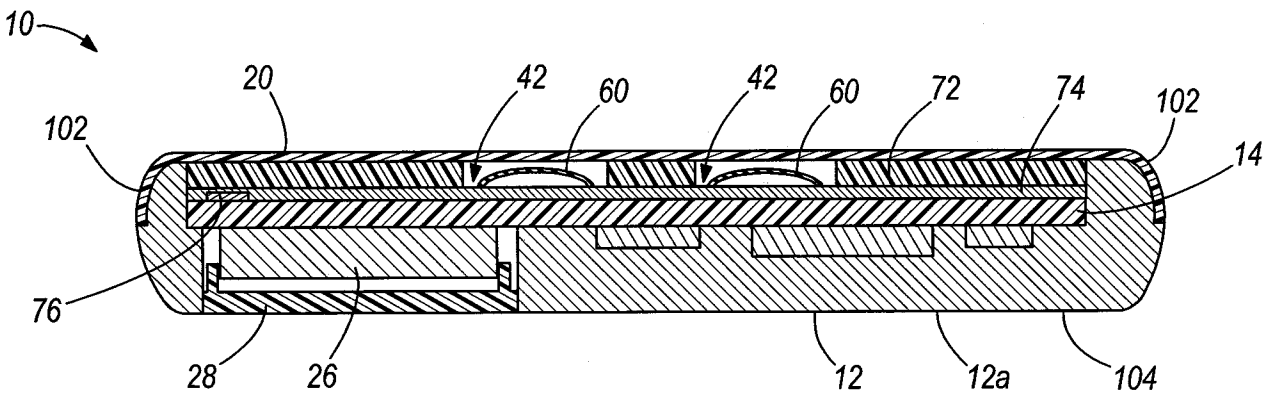
FIG. 30 is a cross-sectional view of a key fob according to another embodiment of the present invention.
Figure 31:
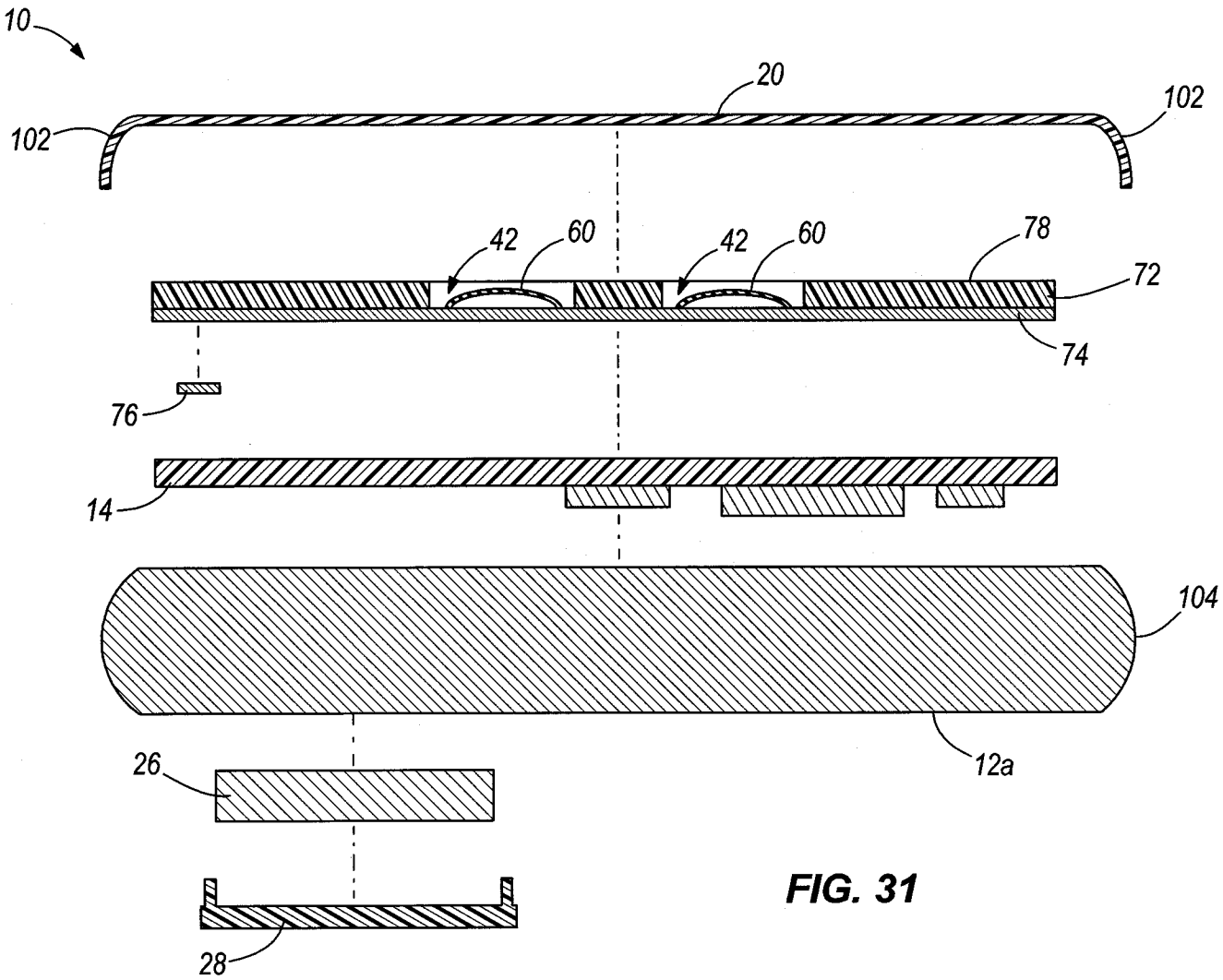
FIG. 31 is an exploded cross-sectional view of the key fob of FIG. 30.

Similarly, in some embodiments, the encapsulating material 104 can itself form or define a lower housing for the key fob 10. For example, as shown in FIGS. 30 and 31, the encapsulating material 104 can be molded to define the lower portion of the key fob 10. As shown in FIGS. 30 and 31, the encapsulating material 104 can encase the spacer layer 72, the flexible circuit 74, the one or more connectors 76, and the PCB 14 within the thermoformed flexible film 20, and can provide an opening for a connection point on the PCB 14 for the battery 26 and the battery access door 28. In some embodiments, the battery access door 28 can be installed and joined with the encapsulating material 104 using a force or snap fit. In other embodiments, the battery access door 38 can be installed and joined with the encapsulating material 104 using an adhesive or by another suitable method. Using the encapsulating material 104 to define the lower housing of the key fob 10 eliminates the need to provide a separate lower housing, such as an injection molded housing, and can thereby reduce manufacturing costs. Similarly, using the encapsulating material 104 to define the lower housing of the key fob 10 can eliminate the need to adhesively bond the flexible film 20 (and/or a separate upper housing) to a lower housing.

It should be understood that the encapsulating material 104 described above with respect to FIGS. 26*a*, 26*b*, and 27-31 can be used in other interior configurations of the key fob 10 described and/or illustrated herein. For example, the encapsulating material 104 can be used in various manners in the configurations described above with respect to FIGS. 2, 4*a*, 4*b*, 5, 7, 11*b*, 13, 18, 20*b*, 22, and 24. In each of these configurations, the encapsulating material 104 can be used to adhere one or more components together and/or to encase one or more components to protect the components from dust, debris, moisture, and shock.

It should also be understood that the interior and exterior configurations described above with respect to FIGS. 1-31 can be combined in various manners. Furthermore, the functionality provided by the components included in the key fob 10 can be combined and/or distributed among fewer or additional components. For example, in some embodiments, the functionality provided by the PCB 14 (e.g., an antenna, a controller or processor, etc.) can be provided by components included in the flexible circuit 74. Similarly, in some embodiments, the functionality provided by the spacer layer 74 can be combined with the flexible film 20 and/or the flexible circuit 74 such that a separate spacer layer 74 is not needed. Furthermore, in some embodiments, the battery 26 can include a flexible battery (e.g., a "paper" battery) that can be joined to the PCB 14 or the flexible circuit 74 using adhesive bonding or by another suitable method. Using this configuration, if the battery 26 is exhausted, the battery 26 can be replaced or a portion of the key fob 10 can be replaced. For example, to replace the battery 26, a new assembly can be installed including a new flexible film 20, a new spacer layer 72, a new flexible circuit 74, and a new battery 26.

Furthermore, in some embodiments, portions of the key fob 10 can be changed or replaced after assembly in order to provide customized features. For example, in some embodiments, the flexible film 20 can be removed and/or overlaid with a new flexible film 20 including customized colors, patterns, textures, and/or graphics (e.g., graphics associated with sports teams, universities, companies, designers, personal photographs, personal names, and the like). In other embodiments, the flexible film 20, spacer layer 72, and flexible circuit 74 can be removed and replaced with a new flexible film 20, spacer layer 72, and flexible circuit 74 to customize the colors and/or graphics, and/or to customize the number and/or locations of the contact surfaces 44 and associated switches on the key fob 10. For example, if a user desires to add or remove a contact surface 44 and associated switch on the key fob 10, the user can replace the flexible film 20, spacer layer 72, and flexible circuit 74 on the key fob 10 with a new flexible film 20, a new spacer layer 72, and a new flexible circuit 74 defining fewer or additional contact surfaces 44 and associated switches.

In some embodiments, an upper housing 12*b* and/or a lower housing 12*a* of the key fob 10 or a portion thereof can be removed to allow a user to replace the flexible film 20, the spacer layer 72, and/or the flexible circuit 74. For example, in some embodiments, the upper housing 12*b* illustrated in FIGS. 11*b* and 12 can be removed to replace the flexible film 20, the spacer layer 72, and/or the flexible circuit 74. Similarly, the upper housing 12*b* illustrated in FIGS. 20*b* and 21, which includes a recess 95 that receives the flexible film 20, spacer layer 72, and flexible circuit 74, can also include a substantially transparent cover or lid that can be pivoted or removed to replace the flexible film 20, the spacer layer 72, and/or the flexible circuit 74 contained within the recess 95. In some embodiments, the one or more connectors 76 between the flexible circuit 74 and the PCB 14 can provide a force or snap fit and/or a reusable or replaceable adhesive to accommodate replacement of the flexible circuit 74. Similarly, other components of the key fob 10 can also provide a force or snap fit and/or a reusable or replaceable adhesive to accommodate the replacement of components after assembly.

Figure 32:
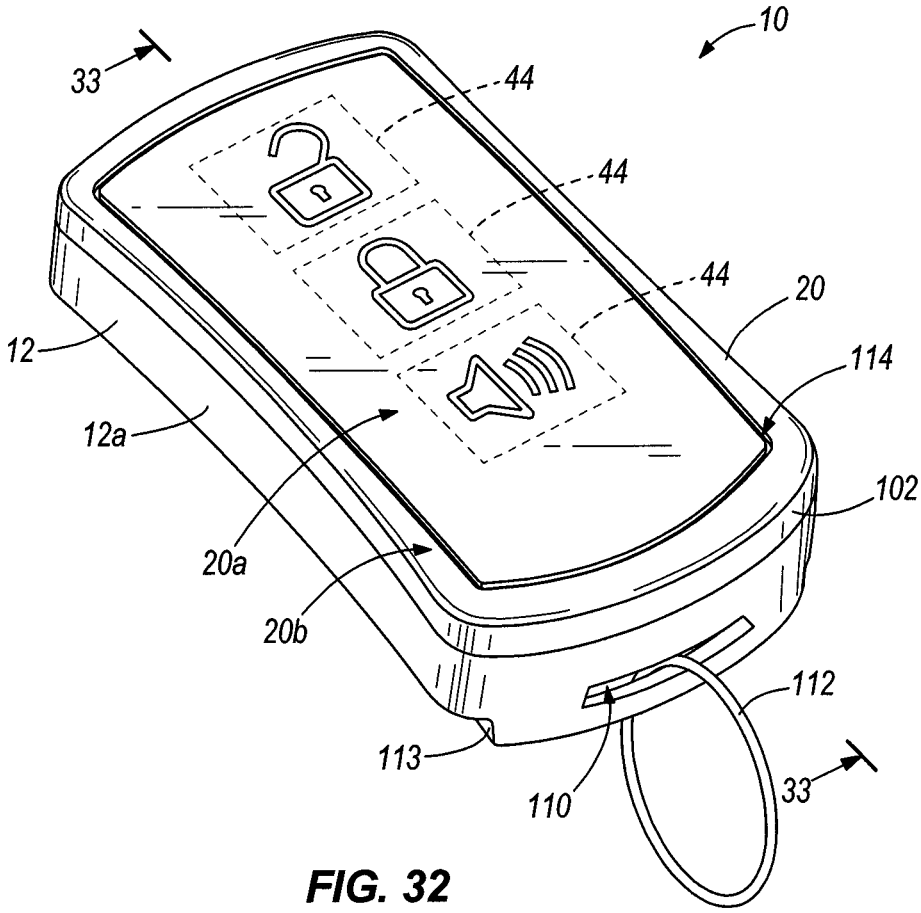
FIG. 32 is a perspective view of a key fob according to an embodiment of the present invention.

It should be understood that the key fobs 10 described and illustrated herein can be configured in various shapes and sizes and with various features. For example, FIG. 32 is a perspective view of a key fob according to another embodiment of the present invention. As shown in FIG. 32, the flexible film 20 of the key fob can include a groove 114. In some embodiments, the groove 114 provides a pseudo "part line" defining one or more sections of the flexible film 20. For example, the groove 114 can define a first area for locking and unlocking vehicle doors and a second area for activating a vehicle alarm. Similarly, as shown in FIG. 32, the groove 114 can define a user interface surface 20*a* including one or more contact surfaces 44 and a side or edge surface 20*b*. In some embodiments, the sections defined by the groove 114 can include different colors, graphics, textures, and/or patterns to further differentiate the sections. For example, the key fob 10 of FIG. 32 includes a first user interface surface with multiple contact surfaces 44 and includes a chrome-colored side surface 20*b*.

As shown in FIG. 32, the key fob 10 can also include an opening 110 for receiving a key ring 112 or other device for hanging the key fob 10 and/or connecting the key fob 10 with other keys, key fobs, key rings, purses, wallets, and the like. In some embodiments, the opening 110 can be formed within the housing 12 of the key fob 10, such as within a lower housing 12*a* and/or an upper housing 12*b*. In other embodiments, the opening 110 can be formed on a ridge 113 extending from the housing 12. It should be understood that the opening 110 and key ring 112 can be at various locations on the key fob 10.

Figure 33:
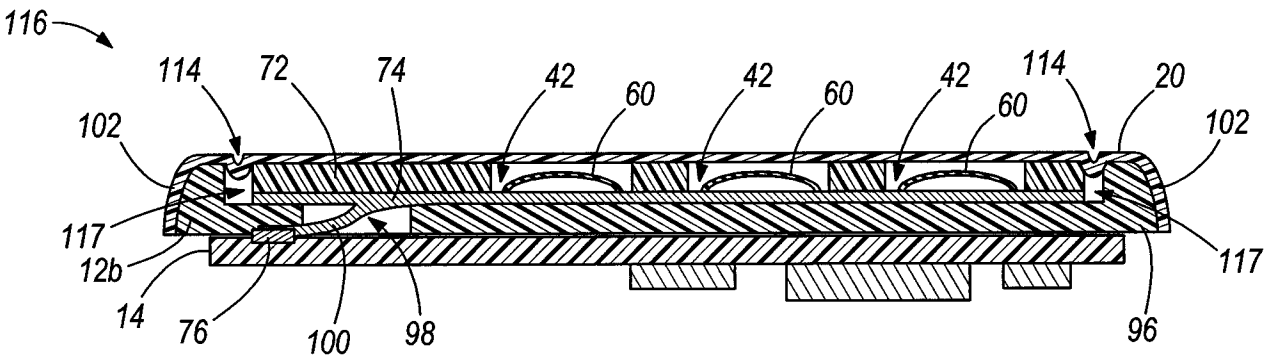
FIG. 33 is a cross-sectional view of an upper assembly of the key fob of FIG. 32, taken along line 33-33 of FIG. 32 according to an embodiment of the present invention.
Figure 34:
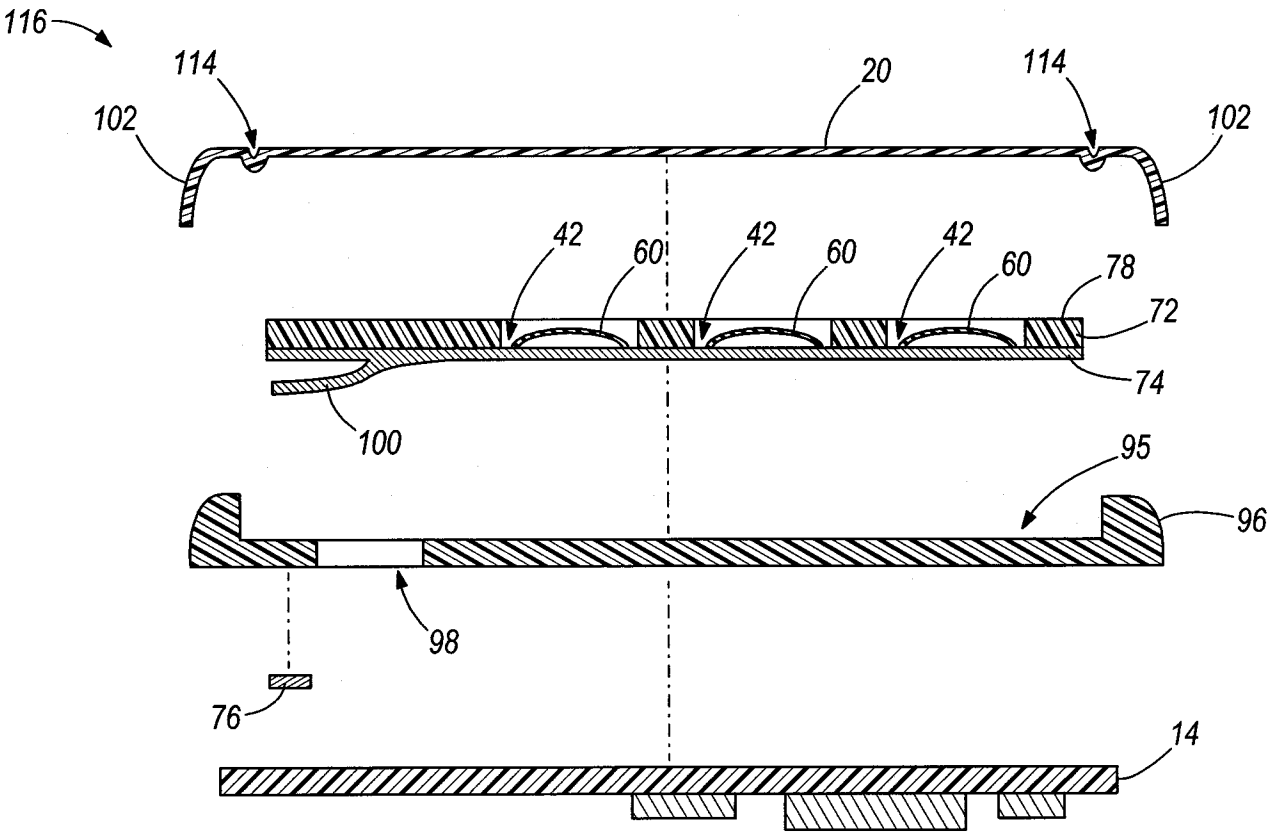
FIG. 34 is an exploded cross-sectional view of the upper assembly of FIG. 33.

FIGS. 33 and 34 are cross-sectional views of an upper assembly 116 of the key fob 10 of FIG. 32, taken along line 33-33 of FIG. 32 according to an embodiment of the present invention. The upper assembly 116 can include an upper housing 12*b*, a flexible film 20, a spacer layer 72, a flexible circuit 74 with a trace tail 100, a connector 76, and a PCB 14. In some embodiments, the flexible film 20 can be thermoformed to match the contour of the upper housing 12*b*, as described above with respect to FIG. 9. As shown in FIG. 33, the groove 114 is positioned over an open space 117 between an edge of the spacer layer 72 and the flexible circuit 74 and an interior edge of the upper housing 12*b*. The open space 117 can receive the groove 114 of the flexible film 20 in order to maintain a substantially continuous height of the flexible film 20.

As shown in FIGS. 33 and 34, the upper housing 12*b* of the key fob 10 can include a recess 95 with a lower surface 96. As described above with respect to FIGS. 21-25, the recess 95 and the lower surface 96 can receive and support the flexible film 20, the spacer layer 72, and the flexible circuit 74. As shown in FIG. 33, the upper housing 12*b* can also include an opening 98 for receiving a trace tail 100 of the flexible circuit 74. As described above with respect to FIGS. 24-25, one or more connectors 76 can be used to connect the trace tail 100 to the PCB 14. It should be understood that other interior configurations described and/or illustrated herein can be used with the groove 114. For example, the flexible film 20 with the groove 114 can be used with the configurations described above with respect to FIGS. 2, 4*a*, 4*b*, 5, 7, 11*b*, 13, 18, 20*b*, 22, 24, 26*b*, 28, and 30.

Thus, some embodiments of the invention provide, among other things, a key fob that can be customized with various numbers and locations of contact surfaces and associated switches in various shapes, sizes, colors, patterns, textures, and other stylized graphics. Accordingly, a group of vehicles of different makes, models, and editions can generally use the same key fob components but have individually customized key fobs by printing different graphics, textures, etc. on the flexible film, providing different spacer layers, and/or providing different flexible circuits, which can provide a significant cost savings.

Although the various devices described and illustrated herein are key fobs, it will be appreciated that many of the features disclosed herein can be employed in other portable and non-portable devices and systems. In short, the features of the present invention can be utilized in any device and system having a user interface in which one or more switches can be actuated by a user to control the device or system (or a device or system connected thereto). Such devices or systems include, without limitation, phones, GPS systems, computers and computer peripheral devices, audio equipment, and the like.

Various features and advantages of the invention are set forth in the following claims.

What is claimed is:

1. A key fob comprising:

a flexible film defining an exterior surface of the key fob including at least one contact surface, the at least one contact surface flexing when a force is applied in order to actuate at least one switch; and encapsulating material defining at least a portion of an interior of the key fob, the encapsulating material lining a portion of an interior surface of the flexible film and bonded thereto, wherein the encapsulating material encases one or both of a) a flexible spacer layer including at least one aperture, and b) a flexible circuit including the at least one switch and at least one connector for connecting the flexible circuit to a printed circuit board.

2. The key fob of claim 1, wherein the encapsulating material includes a low-pressure flowing resin.

3. The key fob of claim 1, wherein encapsulating material includes a polyamide hot melt adhesive.

4. The key fob of claim 1, wherein the encapsulating material defines at least a portion of an exterior surface of the key fob.

5. The key fob of claim 1, wherein the encapsulating material defines at least one joint for joining with a lower housing of the key fob.

6. The key fob of claim 1, wherein the at least one connector includes an elastomeric connector.

7. The key fob of claim 1, wherein the encapsulating material encases the printed circuit board.

8. The key fob of claim 1, wherein the flexible film is formed to substantially match a contour of the encapsulating material.

9. A method of forming a key fob comprising:

providing a flexible film defining an exterior surface of the key fob including at least one contact surface and a surface adjacent to the at least one contact surface, the at least one contact surface flexing when a force is applied in order to actuate at least one switch; and injecting an encapsulating material into an interior of the key fob to define at least a portion of the interior of the key fob.

10. The method of claim 9, wherein injecting the encapsulating material into a mold includes flowing a resin into the mold using low pressure.

11. The method of claim 9, wherein the encapsulating material includes a polyamide hot melt adhesive.

12. The method of claim 9, further comprising injecting the encapsulating material into a mold containing portions of the key fob to define at least one joint for joining with a lower housing of the key fob.

13. The method of claim 9, further comprising providing a flexible spacer layer including at least one aperture and encasing the flexible spacer layer with the encapsulating material.

14. The method of claim 9, further comprising providing a flexible circuit including the at least switch and encasing the flexible circuit with the encapsulating material.

15. The method of claim 14, further comprising providing at least one connector for connecting the flexible circuit with a printed circuit board and encasing the at least one connector with the encapsulating material.

16. The method of claim 15, wherein the at least one connector includes an elastomeric connector.

17. The method of claim 9, further comprising providing a printed circuit board and encasing the printed circuit with the encapsulating material.

18. The method of claim 9, further comprising forming the flexible film to substantially match a contour of the portion of the interior of the key fob defined by the encapsulating material.

19. A key fob comprising:

a first housing portion having an exterior surface and an interior surface;

a second housing portion having an exterior surface and an interior surface, wherein the first and second housing portions meet to define a joint, and the interior surface of the first housing portion and the interior surface of the second housing portion cooperate to at least partially define an internal chamber of the key fob;

a printed circuit board disposed in the chamber;

an encapsulating material occupying at least a portion of the chamber, wherein the encapsulating material lines an interior of the joint to secure the joint.

20. The key fob of claim 19, wherein the encapsulating material includes a low-pressure flowing resin.

21. The key fob of claim 20, wherein the encapsulating material includes a polyamide hot melt adhesive.

22. The key fob of claim 19, wherein the encapsulating material defines a portion of an exterior surface of the key fob.

23. The key fob of claim 19, wherein the encapsulating material at least partially encases the printed circuit board.

24. A key fob comprising:

a flexible film defining an exterior surface of the key fob including at least one contact surface, the at least one contact surface flexing when a force is applied in order to actuate at least one switch; and encapsulating material defining at least a portion of an interior of the key fob, wherein the encapsulating material encases a flexible spacer layer including at least one aperture.

25. A key fob comprising:

a flexible film defining an exterior surface of the key fob including at least one contact surface, the at least one contact surface flexing when a force is applied in order to actuate at least one switch; and encapsulating material defining at least a portion of an interior of the key fob, wherein the encapsulating material encases a flexible circuit including the at least one switch, and wherein the encapsulating material encases at least one connector for connecting the flexible circuit to a printed circuit board.

26. The key fob of claim 25, wherein the at least one connector includes an elastomeric connector.

27. A method of forming a key fob comprising:

providing a flexible film defining an exterior surface of the key fob including at least one contact surface and a surface adjacent to the at least one contact surface, the at least one contact surface flexing when a force is applied in order to actuate at least one switch;

injecting an encapsulating material into a mold to define at least a portion of an interior of the key fob; and providing a flexible spacer layer including at least one aperture and encasing the flexible spacer layer with the encapsulating material.

28. A method of forming a key fob comprising:

providing a flexible film defining an exterior surface of the key fob including at least one contact surface and a surface adjacent to the at least one contact surface, the at least one contact surface flexing when a force is applied in order to actuate at least one switch;

injecting an encapsulating material into a mold to define at least a portion of an interior of the key fob;

providing a flexible circuit including the at least switch and encasing the flexible circuit with the encapsulating material;

providing at least one connector for connecting the flexible circuit with a printed circuit board; and encasing the at least one connector with the encapsulating material.

29. The method of claim 28, wherein the at least one connector includes an elastomeric connector.

30. A method of forming a key fob comprising:

providing a flexible film defining an exterior surface of the key fob including at least one contact surface and a surface adjacent to the at least one contact surface, the at least one contact surface flexing when a force is applied in order to actuate at least one switch; and injecting an encapsulating material into an interior of the key fob to thereby secure the flexible film.

31. A method of forming a key fob comprising:

providing a flexible film defining an exterior surface of the key fob including at least one contact surface and a surface adjacent to the at least one contact surface, the at least one contact surface flexing when a force is applied in order to actuate at least one switch; and providing a housing defining an exterior surface of the key fob, the housing meeting the flexible film at a joint;

injecting an encapsulating material into a mold to define at least a portion of an interior of the key fob, the encapsulating material lining the joint to secure the flexible film and the housing.

* * * * *